US005686926A

United States Patent [19]

Kijima et al.

[11] Patent Number: 5,686,926

[45] Date of Patent: Nov. 11, 1997

[54] MULTIBEAM ANTENNA DEVICES

[75] Inventors: Makoto Kijima, Yokosuka; Yoshihide Yamada; Yoshio Ebine, both of Yokohama; Minoru Kuramoto, Yokosuka, all of Japan

[73] Assignee: NTT Mobile Communications Network Inc., Tokyo, Japan

[21] Appl. No.: 712,196

[22] Filed: Sep. 11, 1996

Related U.S. Application Data

[63] Continuation of Ser. No. 256,926, Oct. 14, 1994, abandoned.

[30] Foreign Application Priority Data

| | | | |
|---|---|---|---|
| Dec. 1, 1992 | [JP] | Japan | 4-322102 |
| Dec. 1, 1992 | [JP] | Japan | 4-322108 |
| Dec. 14, 1992 | [JP] | Japan | 4-333259 |
| Dec. 24, 1992 | [JP] | Japan | 4-344798 |

[51] Int. Cl.[6] ..... H01Q 3/02

[52] U.S. Cl. ..... 342/373; 342/371

[58] Field of Search ..... 342/368, 371–5; 333/117

[56] References Cited

U.S. PATENT DOCUMENTS

| | | | |
|---|---|---|---|
| 3,093,826 | 6/1963 | Fink | 342/373 |
| 3,997,900 | 12/1976 | Chin et al. | 342/373 |
| 5,355,139 | 10/1994 | Hirata et al. | 342/371 |

FOREIGN PATENT DOCUMENTS

| | | |
|---|---|---|
| 56-140702 | 11/1981 | Japan . |
| 59-44105 | 3/1984 | Japan . |
| 61-172411 | 8/1986 | Japan . |
| 63-46019 | 2/1988 | Japan . |
| 63-6019 | 2/1988 | Japan . |
| 2174302 | 7/1990 | Japan . |

*Primary Examiner*—Gregory C. Issing

*Attorney, Agent, or Firm*—Cushman, Darby & Cushman IP Group of Pillsbury Madison & Sutro LLP

[57] ABSTRACT

Two beams with equiangular spacing are formed at a single antenna face, and multiple beams are generated by combining a plurality of such faces. This makes it possible to reduce the size of an antenna device and to decrease the wind load sustained by an antenna, whereby it becomes possible to mount many antennas on a single supporting structure and to achieve substantial weight reduction of a supporting structure.

20 Claims, 28 Drawing Sheets

MULTIBEAM ANTENNA DEVICES

This is a continuation of application No. 08/256,926, filed on Oct. 14, 1994, which was abandoned upon the filing hereof.

TECHNICAL FIELD

This invention is utilized for antenna devices in fixed or mobile radio communication systems. It relates in particular to multibeam antenna devices which can generate a plurality of beams by means of a single antenna.

BACKGROUND TECHNOLOGY

A method hitherto used in the field of mobile radio communications to increase channel capacity is to divide a single zone into a plurality of sector zones. An example of this sort is shown in FIG. 1. In this example, service zone 20 is divided into a plurality of sector zones 21.1, 21.2, . . . . Multibeam antenna device 23 capable of generating a plurality of beams is provided at base station 22 in service zone 20, and main beams 24.1, 24.2, . . . , of this multibeam antenna device 23 are directed at sector zones 21.1, 21.2, . . . , respectively.

A plurality of antennas with narrowed 3 dB beamwidth in the horizontal plane are used as multibeam antenna device 23. Specific examples of the prior art are illustrated in FIG. 2 and FIG. 3. FIG. 2 is a perspective view and FIG. 3 is a sectional view. A plurality of array antennas are used in this prior art, and these are arranged so that each antenna face forms one side of a polygon. That is to say, a plurality of array antennas are formed by arraying a plurality of radiators 31 in each of antenna faces 30.1–30.4, and these array antennas are arranged so that each forms one side of a polygon (in this example, so that four sides of a hexagon are formed by four faces). This results in antenna faces 30.1–30.4 facing directions which differ by 60° from one face to the next, and in main beams 32.1–32.4 being obtained in these respective directions. The 3 dB beamwidths of main beams 32.1–32.4 are set at 60°. Planar radiators or dipole antennas fitted with reflectors are used as radiators 31.

FIG. 4 shows an arrangement for obtaining a beam with any given 3 dB beamwidth. Power divider 42 gives equal-amplitude, equal-phase power to two radiators 41.1 and 41.2 arranged side by side horizontally in antenna face 40. A beam of any desired 3 dB beamwidth can then be formed by adjusting the spacing d of radiators 41.1 and 41.2. A multibeam antenna device can be constructed by arraying such radiator pairs in one face and then combining a plurality of faces. In the prior art examples shown in FIG. 2 and FIG. 3, radiator pairs which have been set to give 3 dB beamwidths of 60° are arranged in four faces, and four beams are formed.

FIG. 5 and FIG. 6 show, in similar fashion to FIG. 2 and FIG. 3, an arrangement wherein six beams are formed using six antenna faces. Antenna faces 30.5–30.10 are arranged in a hexagon and a plurality of radiators 31 are arrayed in each face.

However, the fact that these conventional multibeam antenna devices require the same number of antenna faces as the number of beams means that the overall device is large and occupies a large volume. Because this will be accompanied by an increased wind load, a problem is that the supporting structure is also large.

The purpose of the present invention is to provide multibeam antenna devices which, by being compact and lightweight, result in a small wind load and in a more compact supporting structure being possible, thereby solving the above-mentioned problem.

DISCLOSURE OF THE INVENTION

In respect of multibeam antenna devices wherein antenna elements are arranged along at least two sides of a polygon, and wherein on each of these sides the antenna element forms a directional beam outwards from this polygon, this invention provides a multibeam antenna device characterized in that each antenna element forms two directional beams. In virtue of this constitution, 2 n beams can be formed at equiangular intervals by n antenna elements, and both the device and its supporting structure can be made smaller. Accompanying this reduction in, size, the wind load sustained by the antenna elements can be decreased.

A multibeam antenna device according to this invention can be utilized, not only for transmitting, but also for receiving. Accordingly, the statement "directional beams are formed" means not only that radio waves can be radiated in certain specified directions, but also that radio waves can be received from those directions.

Two adjacent antenna elements should have a construction such that they direct their respective beams mutually outwards, and such that they are mutually connected at split angle $\beta$ [degrees] ($\beta<180°$).

In this specification, "beam direction" or "direction of beam" signify the direction of the center of the range within which transmission and reception are performed by the beam. Consequently, in the case of a single beam, the beam direction can be defined as the direction of the center of the range within which the radiated power drops by 3 dB from its maximum value (i.e., the center of the 3 dB width). According to this definition, when the beam shape is symmetrical with respect to the direction in which the radiated power becomes maximum (the peak point), the direction of this peak point constitutes the beam direction. Even when two beams are present, if there is no overlap in the respective 3 dB widths, they can each be regarded as a single beam and the same definition used. In practice, however, it is desirable for the 3 dB widths of two directional beams to be in mutual contact, and some degree of overlap is permissible. Under such circumstances, the range within which transmission and reception are performed will be divided by the center of the overlap. In this specification, therefore, "3 dB beamwidth" will in such a case be defined as the angular range from the center point of the two beams (i.e., the point intermediate between the two peak points) to the −3 dB point on the opposite side of the peak point from this center point, and "beam direction" will be defined as the direction of the center of this range.

Each antenna element should have two radiators and a means which sets the relative phase angles of the feeds to these two radiators. A hybrid circuit is used as the means for setting the feed phase angles, the hybrid circuit containing a first and a second antenna-side terminal and a first and a second base station-side terminal, and having directional coupling characteristics such that the respective signals at the first and second base station-side terminals become 90° out-of-phase signals at the first and second antenna-side terminals. It is also feasible to provide a phase shifter between the hybrid circuit and at least one of the radiators. If a phase shifter is not provided, the two directional beams will be formed symmetrically to the perpendicular to the face which contains the line segment that joins the center points of the two radiators (hereinafter, this will be termed "the antenna face"). As opposed to this, if a phase shifter has been provided, the beam directions can be changed by changing the relative phase angles of the feeds to the two radiators, and beams can be formed in such a manner that the directions of their centers are asymmetrical to the perpendicular to the antenna face.

It is also feasible to use, for each antenna element, an array antenna comprising two groups of radiators.

When the two directional beams at each antenna element are formed symmetrically to the perpendicular to the antenna face, if the angle between these two directional beams (the angle formed by the beam directions) is $\alpha$ [degrees], then two adjacent antenna elements should be arranged so that the split angle $\beta$ is substantially given by:

$$\beta=180-2\alpha$$

If this arrangement is adopted, four directional beams can be arranged at equiangular intervals of a to each other.

When the two directional beams at each antenna element are formed asymmetrically to the perpendicular to the antenna face, two adjacent antenna elements may be arranged so that their respective directional beams are rotationally symmetrical about a point, or so that the beams are mirror symmetrical with respect to the plane which bisects split angle $\beta$. In the former case, the two antenna elements are arranged in similar fashion to the case where the two directional beams are symmetrical: namely, so that split angle $\beta$ is substantially given by:

$$\beta=180-2\alpha$$

In the latter case, if the angle of inclination of the straight line which bisects the angle formed by the two directional beams is $\delta$ (where an inclination from the perpendicular to the antenna face in the direction of the joining part is taken as a positive inclination), the two antenna elements are arranged so that split angle $\beta$ is substantially given by:

$$\beta=180-2(\alpha+\delta)$$

In either case, the four directional beams are arranged at equiangular intervals of $\alpha$ to each other.

When two directional beams are formed asymmetrically to the perpendicular to the antenna face using two radiators or two groups of radiators as the antenna elements, each radiator should be arranged so that a perpendicular to its face is nearly parallel to the straight line bisecting the angle formed by the two directional beams. In other words, each radiator should be arranged with its face rotated by an angle of approximately $\delta$ with respect to the antenna face. This serves the purpose of preventing a difference in power between the two directional beams.

Although antenna elements may be arranged on only some of the sides of a polygon, they can also be arranged on all of the sides. In this latter case, if a regular n-sided polygon is used, the angle at between the two directional beams at each antenna element should be set so that:

$$\alpha=180/n \text{ [degrees]}$$

The tilt angle $\theta_t$ of a directional beam is the angle of inclination of the beam to a face (in practice, a horizontal plane) which orthogonally intersects the axis of the polygon around which the antenna faces are arranged (in practice, this will be a vertical axis). This tilt angle may simply be $\theta_t=0$. However, a tilted beam where $\theta_t\neq 0$ may be necessary for some applications. For example, in the case of a base station for a cellular mobile telephone system, tilted beams (where the radiated beams are displaced downwards from the horizontal plane) are used to achieve frequency reuse between a cell zone. The tilt angle $\theta_t$ under these circumstances is determined by the height of the antenna above ground and the zone radius, and it will be necessary to employ different beam tilt angles at base stations with different heights. A base station antenna with a variable beam tilt angle has therefore previously been used in such applications. The present invention can be implemented utilizing this sort of antenna as well.

Specifically, two directional beams with any desired beam tilt angle can be formed from a single antenna element by using, as the antenna element, two array antennas each of which has N radiators arranged in a line within a vertical plane; dividing the N radiators of each array antenna into M blocks and giving a different excitation phase to each block; and setting different phase angles for the feed to the two array antennas.

It is also possible to vary the tilt angle of the two beams independently. To accomplish this, each antenna element has the following constitution. Namely, a first array antenna comprising N vertically arrayed radiators (where N is an integer equal to or greater than 2) and a second array antenna with approximately the same constitution as this first array antenna, are arranged so as to be adjacent to one another. Each array antenna is divided into M blocks (where M is an integer such that $2\leqq M\leqq N$) and there is provided a plural number M of hybrid circuits. These hybrid circuits each contain a first and a second antenna-side terminal and a first and a second base station-side terminal, and have directional coupling characteristics such that the respective signals at these base station-side terminals become 90° out-of-phase signals at the two antenna-side terminals. There are provided M first phase shifters and M second phase shifters, and a first and a second power divider which each have M terminals on the antenna side and one terminal on the base station side. The first and second antenna-side terminals of the hybrid circuit corresponding to a given pair of horizontally adjacent blocks of the first and second array antennas are respectively connected to the radiators of those blocks. The first base station-side terminals of the M hybrid circuits are respectively connected via first phase shifters to the first power divider, while the second base station-side terminals of the M hybrid circuits are respectively connected via second phase shifters to the second power divider.

To achieve the same purpose, each antenna element can also have the following constitution. Namely, a first array antenna comprising N vertically arrayed radiators (where N is an integer equal to or greater than 2) and a second array antenna with approximately the same constitution as this first array antenna, are arranged so as to be adjacent to one another. Each array antenna is divided into M blocks (where M is an integer such that $2\leqq M\leqq N$) and there is provided a plurality of hybrid circuits. These hybrid circuits each contain a first and a second antenna-side terminal and a first and a second base station-side terminal, and have directional coupling characteristics such that the respective signals at these base station-side terminals become 90° out-of-phase signals at the two antenna-side terminals. There are provided a plurality of first phase shifters, a plurality of second phase shifters, and a first and a second power divider which each have a plurality of terminals on the antenna side and one terminal on the base station side. Horizontally adjacent radiators of the first and second array antennas are respectively connected to the first and second antenna-side terminals of the corresponding hybrid circuit. The first base station-side terminals of the hybrid circuits pertaining to the same block are joined together and connected, via a first phase shifter, to the first power divider; while the second base station-side terminals of the hybrid circuits pertaining to the same block are joined together and connected, via a second phase shifter, to the second power divider.

Each antenna element may also have the following constitution. Namely, a first array antenna comprising N vertically arrayed radiators (where N is an integer equal to or greater than 2) and a second array antenna with approximately the same constitution as this first array antenna, are arranged so as to be adjacent to one another. Each array antenna is divided into M blocks (where M is an integer such that $2 \leqq M \leqq N$) and there is provided a plurality of hybrid circuits. These hybrid circuits each contain a first and a second antenna-side terminal and a first and a second base station-side terminal, and have directional coupling characteristics such that the respective signals at these base station-side terminals become 90° out-of-phase signals at the two antenna-side terminals. There are provided M first phase shifters, M second phase shifters, a first and a second power divider which each have a plurality of terminals on the antenna side and one terminal on the base station side, and M third and M fourth power dividers which each have a plurality of terminals on the antenna side and one terminal on the base station side. The first and second antenna-side terminals of a hybrid circuit corresponding to two horizontally adjacent radiators of the first and second array antennas are respectively connected to the radiators. The first base station-side terminals of hybrid circuits pertaining to the same block are respectively connected to the antenna-side terminals of a third power divider; while the second base station-side terminals of hybrid circuits pertaining to the same block are respectively connected to the antenna-side terminals of a fourth power divider. The base station-side terminals of these third and fourth power dividers are respectively connected via first and second phase shifters to the first and second power dividers.

Embodiments of this invention will now be explained with reference to the drawings.

OPTIMUM CONFIGURATIONS FOR IMPLEMENTING THE INVENTION

Figure 1:
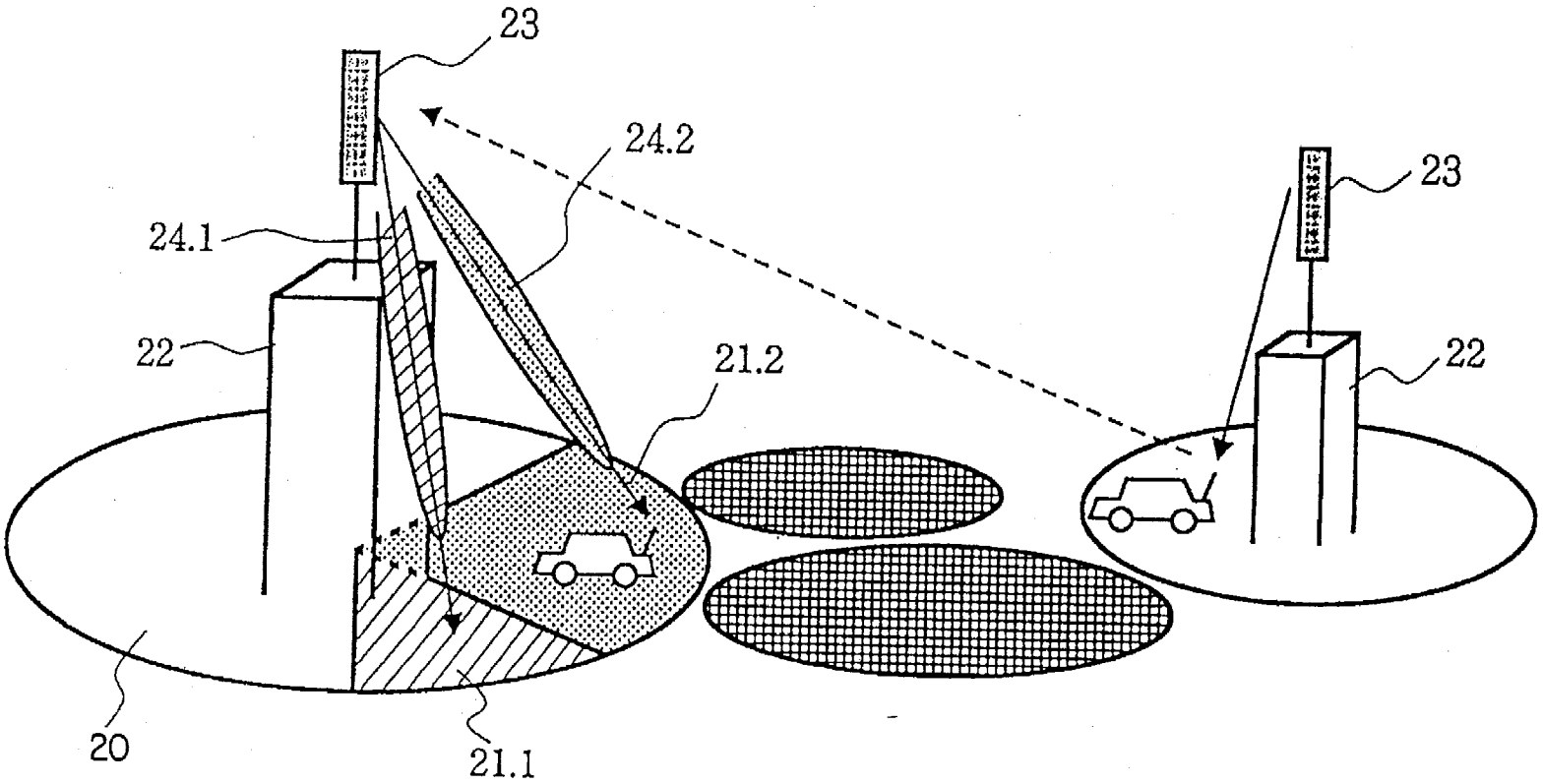
Prior Art Fig.1
FIG. 1 serves to explain the conventional division of the radio zone in mobile radio communications into a plurality of sector zones.
Figure 2:
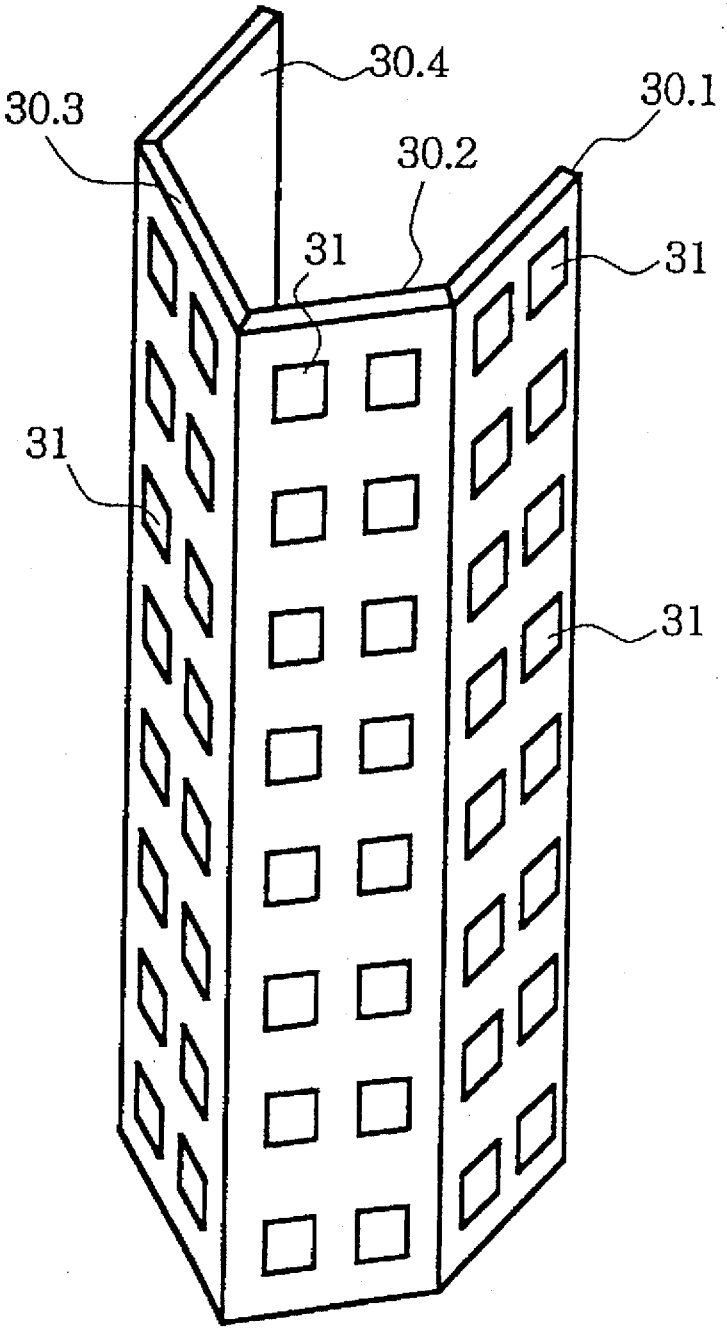
Prior Art Fig.2
FIG. 2 is a perspective view showing the constitution of a prior art example of a 4-beam antenna device.
Figure 3:
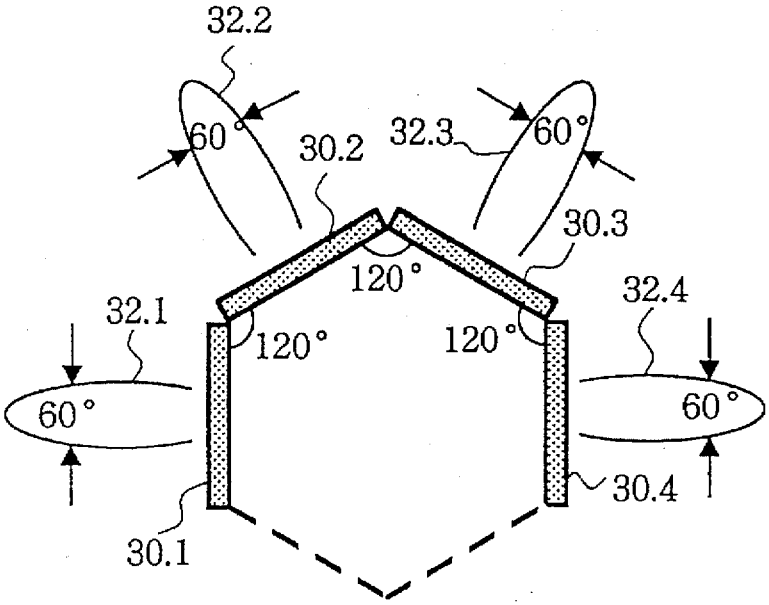
Prior Art Fig.3
FIG. 3 shows the corresponding cross-section and the radiation pattern of the main beams.
Figure 4:
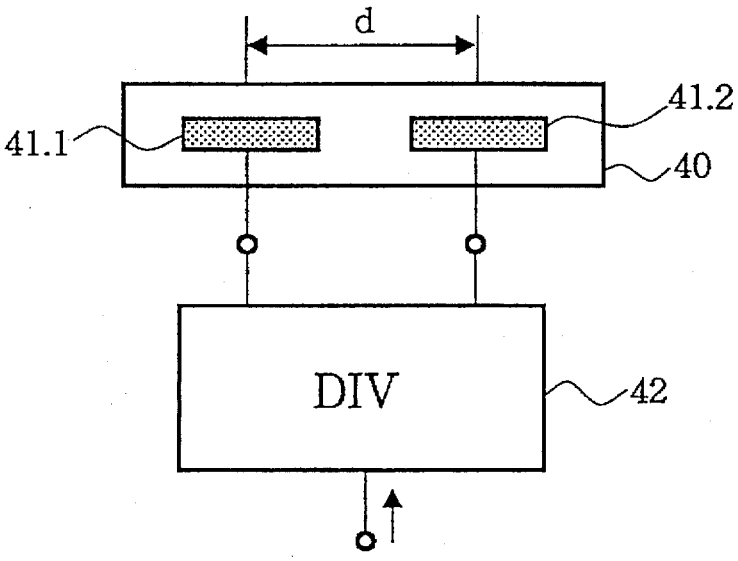
Prior Art Fig.4
FIG. 4 shows an example of a conventional constitution whereby a beam with any desired 3 dB beamwidth can be obtained.
Figure 5:
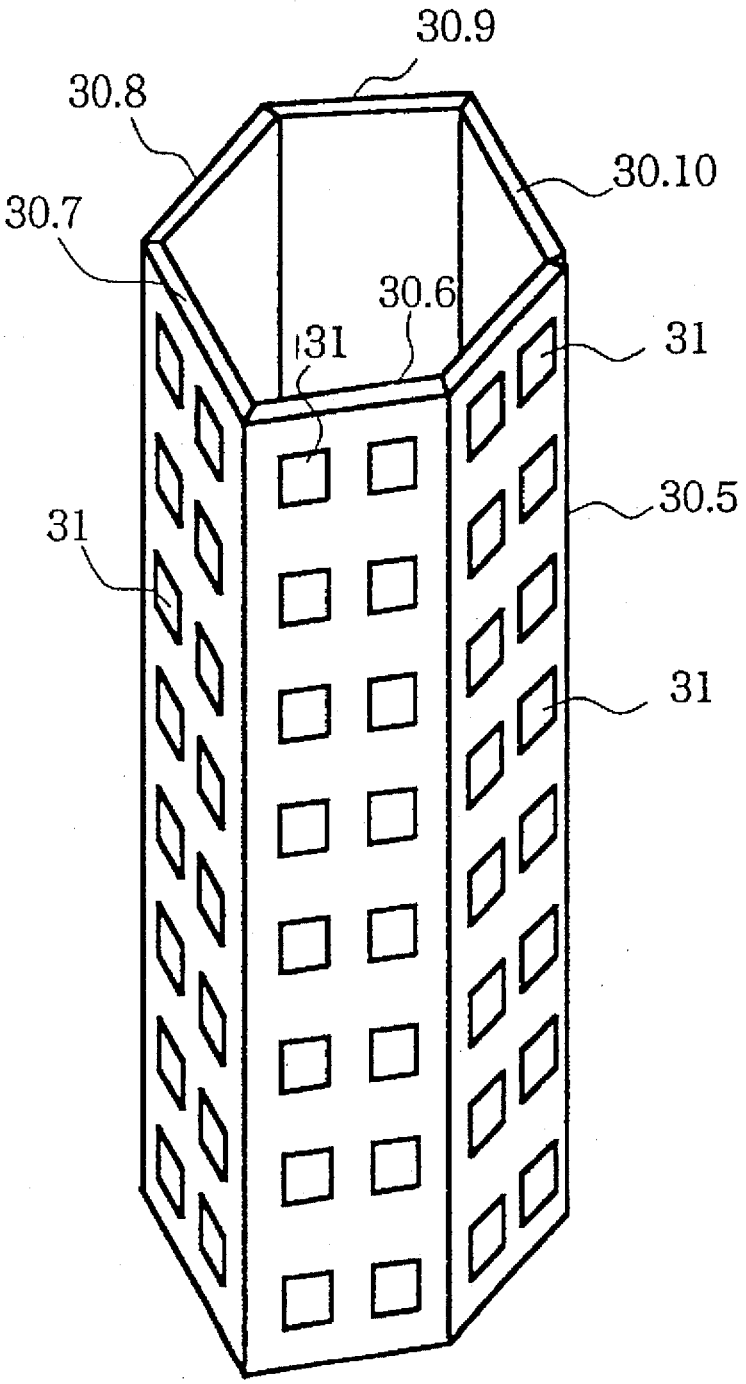
Prior Art Fig.5
FIG. 5 is a perspective view showing the constitution of a prior art example of a 6-beam antenna device.
Figure 6:
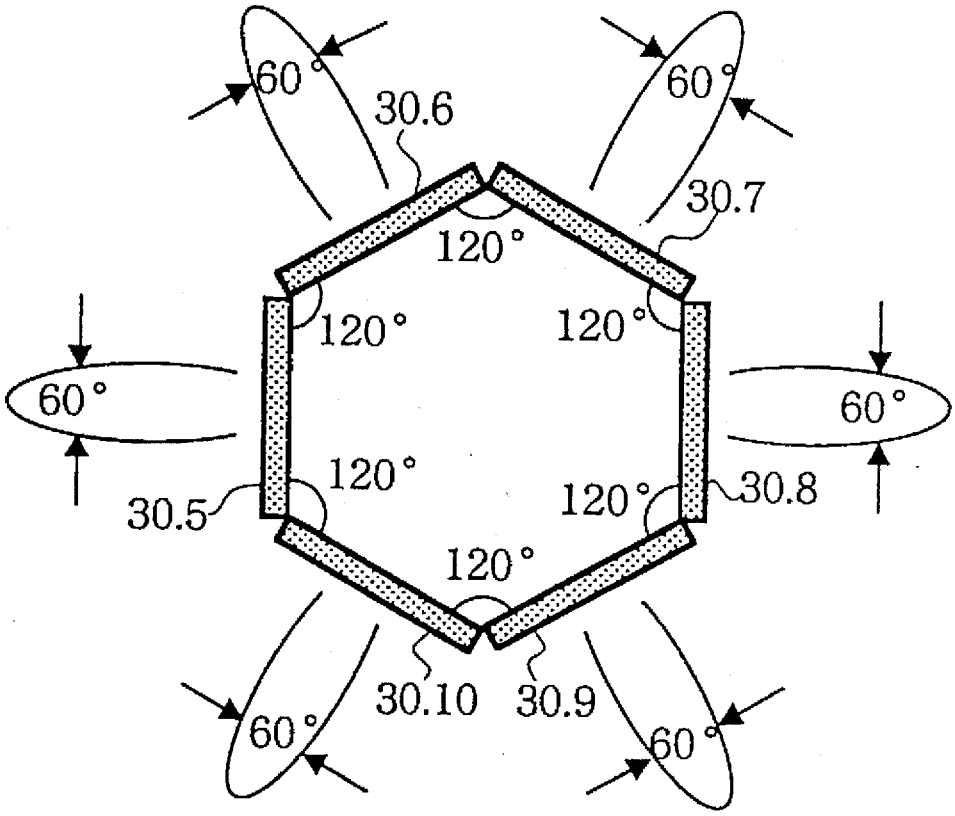
Prior Art Fig.6
FIG. 6 shows the corresponding cross-section and the radiation pattern of the main beams.
Figure 7:
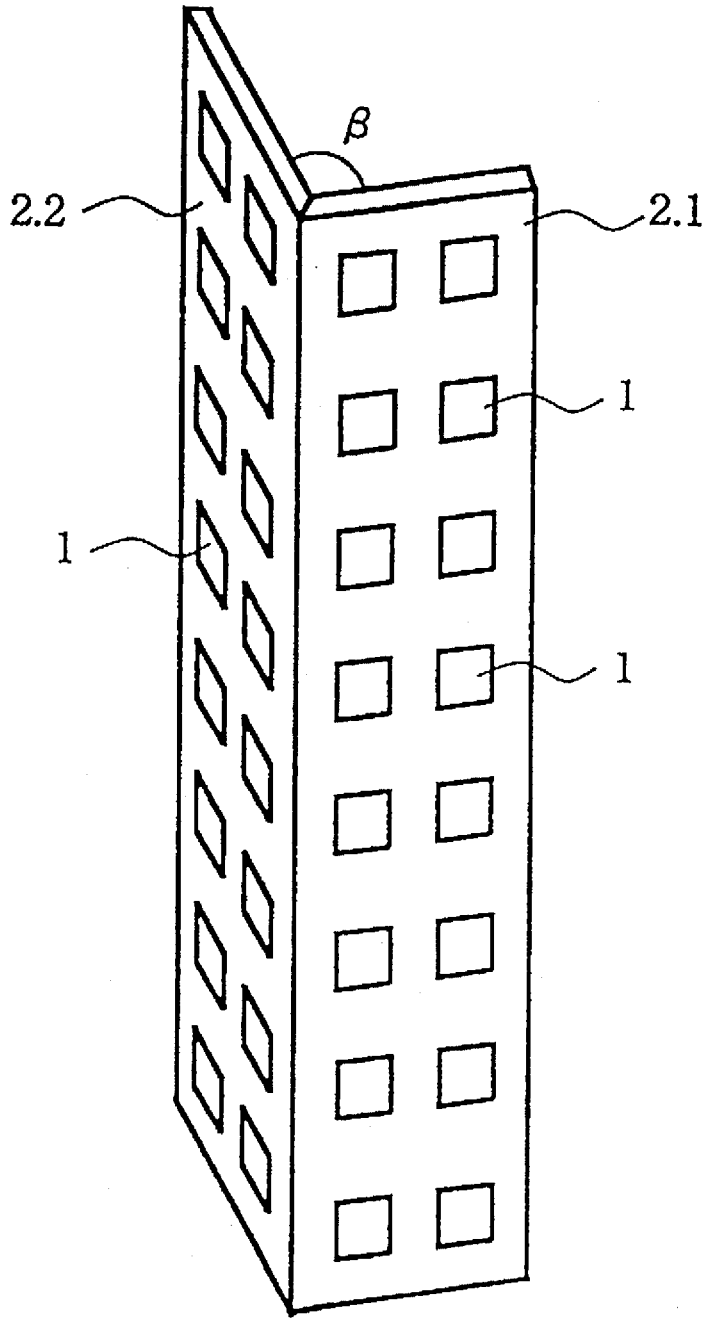
FIG. 7 is a perspective view showing the constitution of a first embodiment of this invention.
Figure 8:
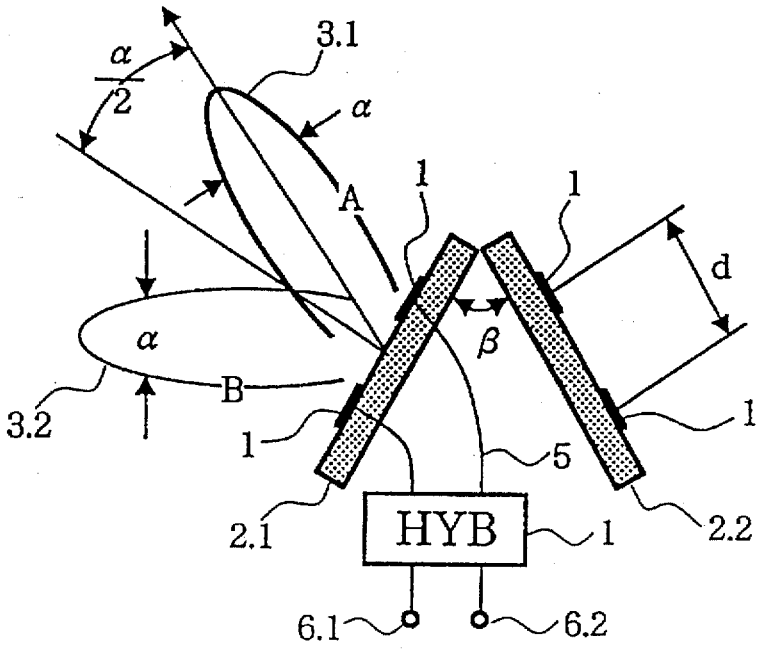
FIG. 8 shows the cross-section and the main beam radiation pattern of the first embodiment.

FIG. 7 is a perspective view showing the constitution of a first embodiment of this invention, while FIG. 8 shows the corresponding cross-section and main beam radiation pattern.

This embodiment has two antenna elements, and these two antenna elements are arranged along two sides of a triangle so as to form directional beams (also called "main beams") to the outside of this triangle. In this embodiment, array antennas are used as the antenna elements, and antenna faces 2.1 and 2.2 are mutually joined at a split angle β [degrees] (β<180°) in such manner that the beam directions face outwards. A plurality of radiators 1 are arranged in two vertical lines on each of antenna faces 2.1 and 2.2. Each pair of radiators 1 arranged horizontally side by side is connected via feed lines 5 to the antenna-side terminals of hybrid circuit 4. This hybrid circuit 4 has directional coupling characteristics such that the respective signals at base station-side terminals 6.1 and 6.2 become 90° out-of-phase signals at the two antenna-side terminals. Consequently, during radiation, signal A which has been input to base station-side terminal 6.1 will form main beam 3.1 which is inclined at an angle α/2 from the normal to the antenna face, while signal B which has been input to base station-side terminal 6.2 will form main beam 3.2 which is inclined at an angle α/2 in the opposite direction from the normal to the antenna face. During reception, the signal received by main beam 3.1 will be output to base station-side terminal 6.1, and the signal received by main beam 3.2 will be output to base station-side terminal 6.2.

A planar antenna such as a patch antenna or a slot antenna can be used as radiator 1.

In this embodiment, two directional beams are formed symmetrically with respect to the perpendicular to the antenna face of each antenna element. If the angle between the two main beams at each antenna element (the angle between the beam centers) is α [degrees], then the split angle β of antenna faces 2.1 and 2.2 is set so that it is substantially given by:

$$\beta=180-2\alpha \tag{1}$$

If this arrangement is adopted, four beams can be arranged at equiangular intervals to each other. If the 3 dB beamwidth γ of each beam is equal to α [degrees], then the region covered by the four beams will be continuous.

Figure 9:
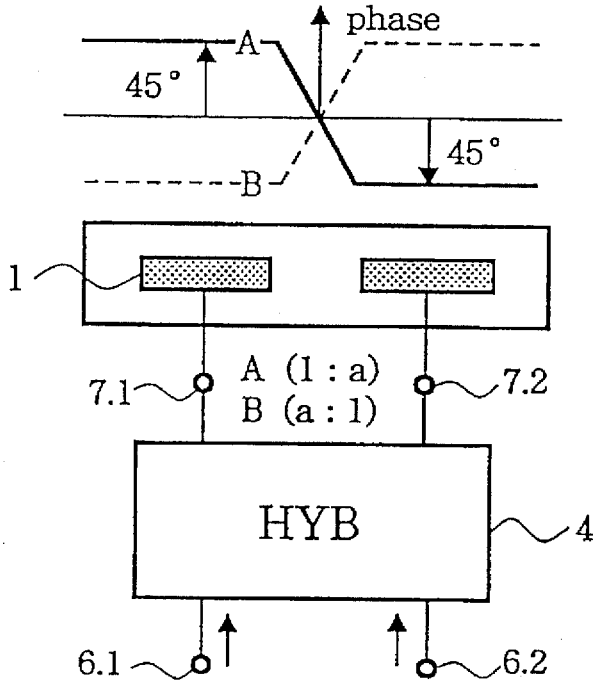
FIG. 9 serves to explain how two beams are formed by two radiators arranged in a single antenna face.

FIG. 9 serves to explain how two beams are formed by two radiators arranged on a single antenna face. During radiation, signals A and B are input to base station-side terminals 6.1 and 6.2, respectively. Hybrid circuit 4 distributes signal A, which has been input to base station-side terminal 6.1, to the two antenna-side terminals 7.1 and 7.2 in such manner that the power distribution ratio becomes 1:α, and the phase at antenna-side terminal 7.1 will then be 90° ahead of the phase at antenna-side terminal 7.2. Conversely, signal B, which has been input from base station-side terminal 6.2, has a power distribution ratio of α:1, and the phase at antenna-side terminal 7.2 will be 90° ahead of the phase at antenna-side terminal 7.1.

Under these circumstances, if the spacing between the two radiators i which are connected to antenna-side terminals 7.1 and 7.2 is d [mm] and the wavelength is λ [mm], then the power directionality of the antenna depicted in FIG. 9 will be given by the following equation when radiators 1 are omni-directional:

$$f(\theta)=2\cos^2\left(\frac{180d}{\lambda}\sin\theta\pm 45\right) \tag{2}$$

In this equation, an addition on the right-hand side expresses signal B, while a subtraction expresses signal A. In Equation 2, the maximum value is obtained at the angle α/2, at which:

$$\frac{180d}{\lambda}\sin\left(\frac{\alpha}{2}\right)=\pm 45\ \text{[units: degrees]} \tag{3}$$

The split angle α of the two beams is therefore given by the following equation:

$$\alpha=2\sin^{-1}\left(\frac{\lambda}{4d}\right) \tag{4}$$

Equation 4 shows that any desired beam split angle can be set by appropriate selection of dement spacing d.

Figure 10:
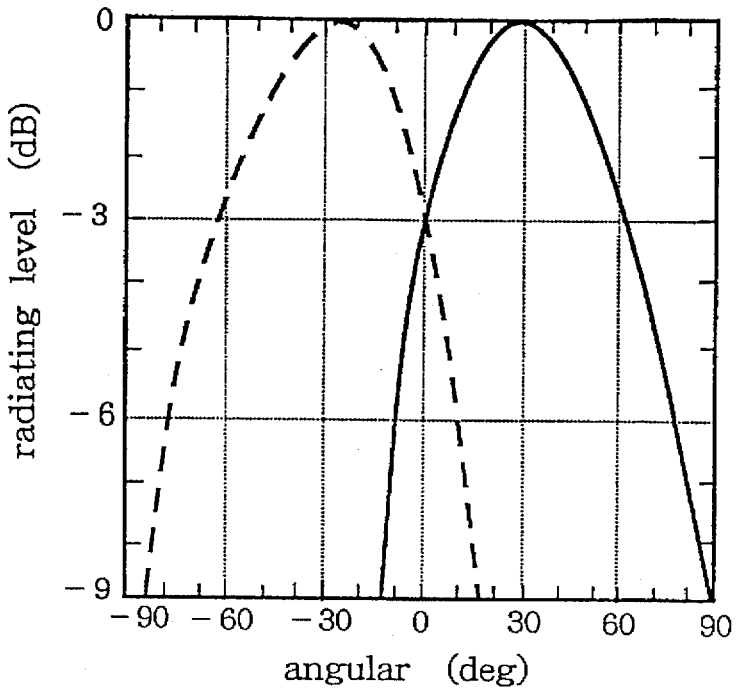
FIG. 10 shows an example of 2-beam radiation directivity.

FIG. 10 shows an example of 2-beam radiation directivity, based on the assumptions that the power distribution ratio of hybrid circuit 4 is 1:1 and that radiators 1 have a 3 dB beamwidth of 150°. It will be seen that when the spacing of radiators 1 is 0.5 wavelengths, the beam split angle and the 3 dB beamwidth both become approximately 60°. Thus, two beams with a 3 dB beamwidth which is approximately equal to the beam split angle can be formed by connecting hybrid circuit 4 to two radiators 1 and selecting the spacing of radiators 1 appropriately. Four beams with equal spacing can therefore be formed by using an antenna formed in this manner as one face and arranging two such faces at the split angle given in Equation 1.

If the 3 dB beamwidth of radiators 1 were narrower, the split angle and 3 dB beamwidth of the beams of a two-dement array antenna would become slightly smaller than the value given in Equation 4. In this case, the beam split angle could be adjusted to the desired value by altering the spacing of radiators 1 and the power distribution ratio of hybrid circuit 4.

Figure 11:
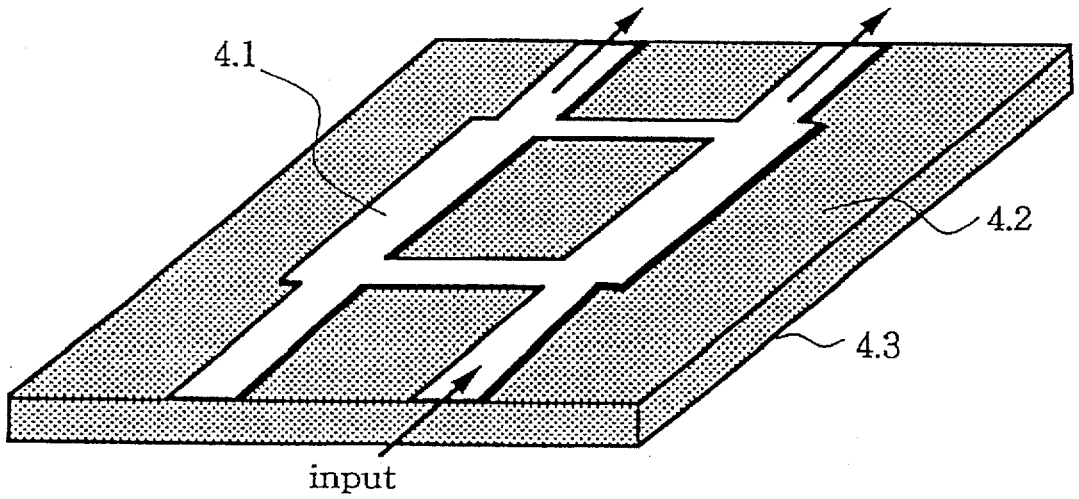
FIG. 11 shows an exemplification of a hybrid circuit, and is a perspective view showing a constitution where the hybrid circuit has been implemented using microstrip lines.

FIG. 11 shows an exemplification of a hybrid circuit, and is a perspective view showing a constitution where the hybrid circuit has been implemented using microstrip lines. This circuit comprises copper foil 4.1 arranged and fixed on the top surface of dielectric substrate 4.2, on the bottom of which copper foil 4.3 has been attached.

Figure 12:
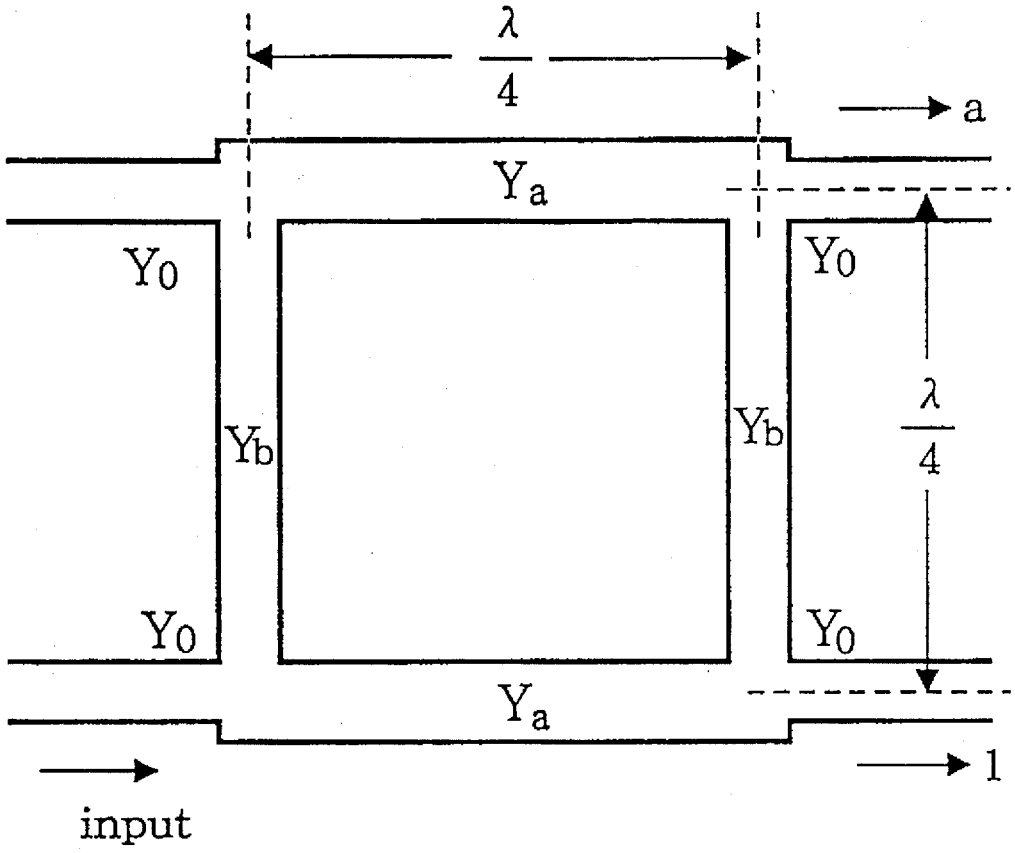
FIG. 12 serves to explain the power division ratio of the hybrid circuit.

FIG. 12 serves to explain the power distribution ratio of a hybrid circuit thus constituted. Letting Y indicate the characteristic admittance of the lines:

$$Y_0^2=Y_a^2-Y_b^2$$

and the power distribution ratio a will be:

$$a=10\log\left[\frac{\left(\frac{Y_a}{Y_b}\right)^2}{1-\left(\frac{Y_a}{Y_b}\right)^2}\right]\ \text{[dB]}$$

Figure 13:
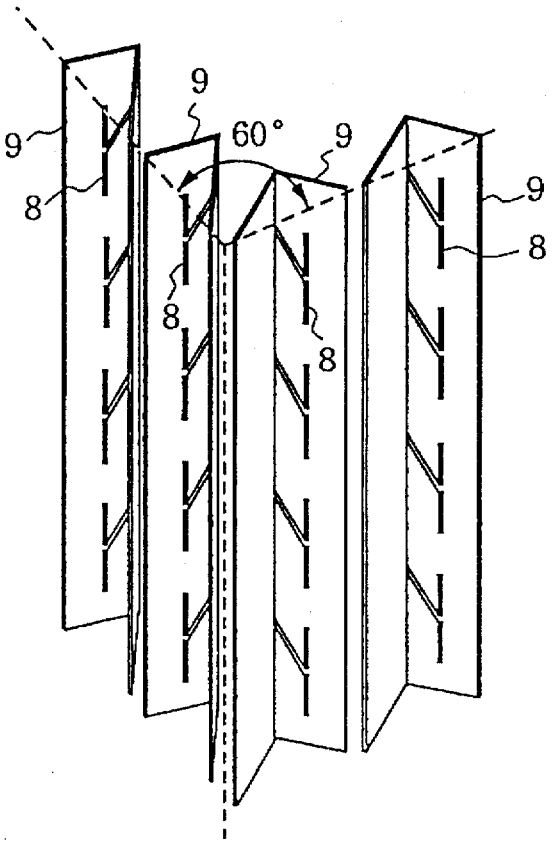
FIG. 13 is a perspective view showing the constitution of a second embodiment of this invention.
Figure 14:
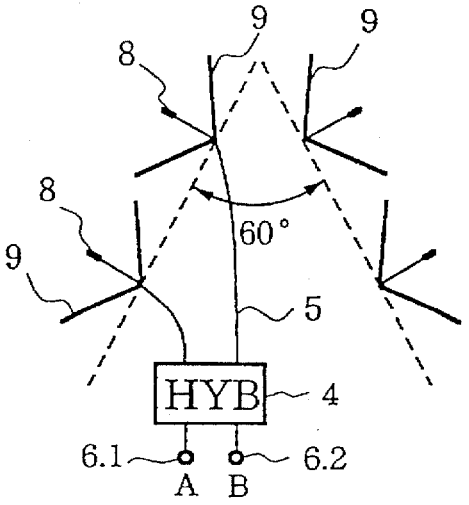
FIG. 14 is a cross-sectional view of the second embodiment.

FIG. 13 is a perspective view showing the constitution of a second embodiment of this invention, and FIG. 14 is the corresponding cross-sectional view.

This embodiment is one which uses dipole antennas fitted with reflectors as the radiators. Dipole antennas 8 are fitted in a line to reflector 9, and two such assemblies comprise an antenna element. These antenna elements are arranged so that the split angle β of the antenna faces is 60°, for example. In similar manner to the first embodiment, this embodiment enables four equally-spaced beams to be formed by using hybrid circuit 4 to combine the beams from two reflector-fitted dipole antennas facing in the same direction, and then employing this assembly on two faces.

In the above embodiment, the situation explained was that of two beams being formed symmetrically with respect to the perpendicular to the antenna face. When the two beams are formed asymmetrically, if this is a matter of the beams being inclined at the same angle and in the same rotational direction at each antenna element, equal spacing of the four beams can be achieved by setting the split angle β between the antenna elements to the value given by Equation 1. However, if the inclination of the beams at the two antenna elements is mirror-symmetrical, the beams cannot be arranged with equal spacing by setting β in accordance with Equation 1. An explanation will now be given of an embodiment of such a case.

Figure 15:
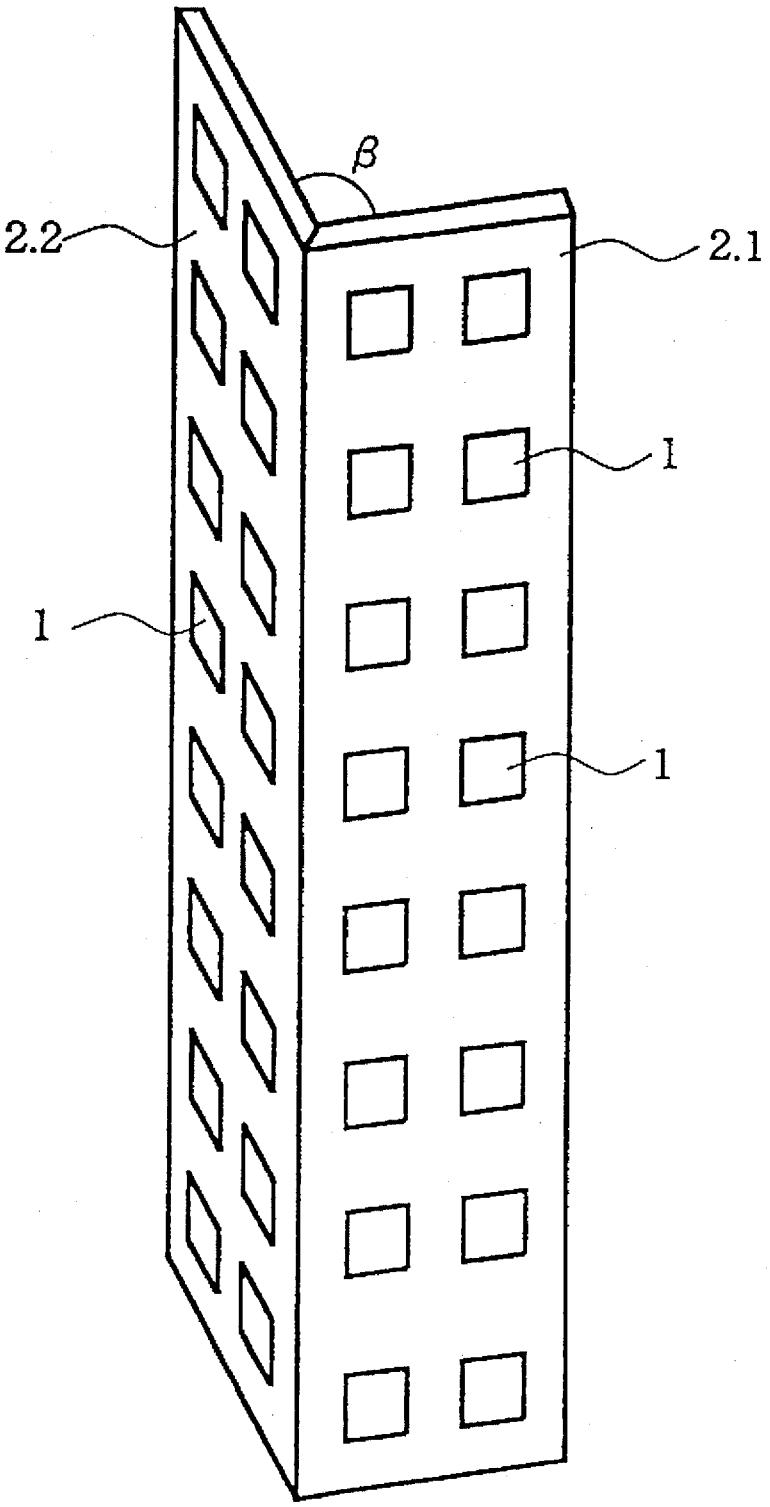
FIG. 15 is a perspective view showing the constitution of a third embodiment of this invention.
Figure 16:
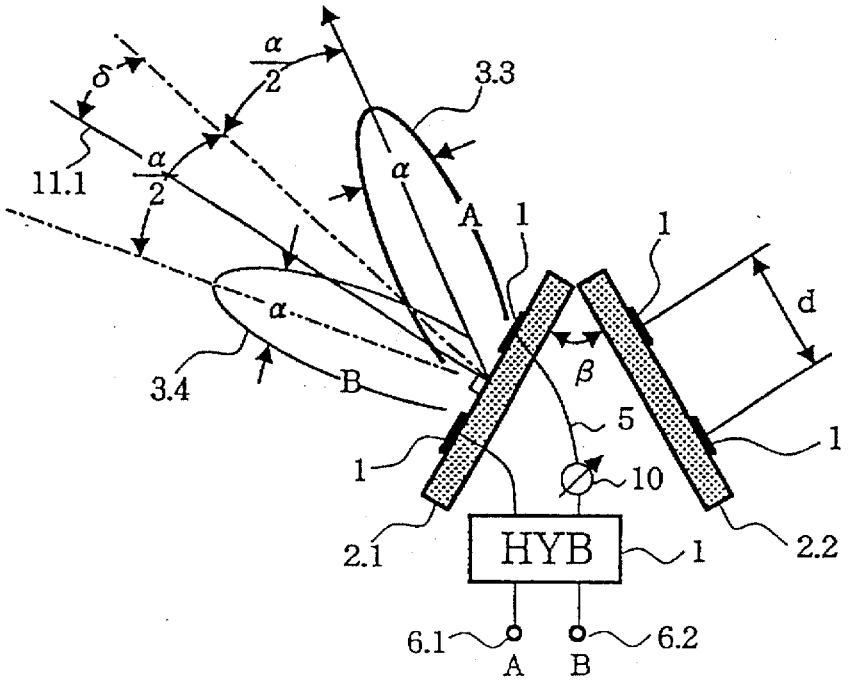
FIG. 16 shows the cross-section and the main beam radiation pattern of the third embodiment.

FIG. 15 is a perspective view showing the constitution of a third embodiment of this invention, and FIG. 16 shows the corresponding cross-section and main beam radiation pattern.

As regards the arrangement of the antenna elements, this embodiment is similar to the first embodiment illustrated in FIG. 7. Nevertheless, it differs from the first embodiment in that the two beams obtained from an antenna element (FIG. 16 shows main beams 3.3 and 3.4 obtained from one antenna element) are asymmetrical with respect to the perpendicular to the antenna face, and in that the inclination of the beams is mirror-symmetrical between the two antenna elements. That is to say, the two antenna elements (each of which generates two directional beams) are joined at a split angle β which is smaller than 180° and which is set so that:

$$\beta=180-2(\alpha+\delta)\ \text{[degrees]} \tag{5}$$

where α is the angle between the two main beams and δ is the angle between the straight line bisecting this angle α and perpendicular 11.1 to the face of the antenna elements (where an inclination from the perpendicular to the antenna face in the direction of the joining part is taken as a positive inclination). If this arrangement is adopted, four beams can be arranged at equiangular intervals to each other. Moreover, if the 3 dB beamwidth of each beam is α [degrees], the region covered by the four beams will be continuous.

Figure 17:
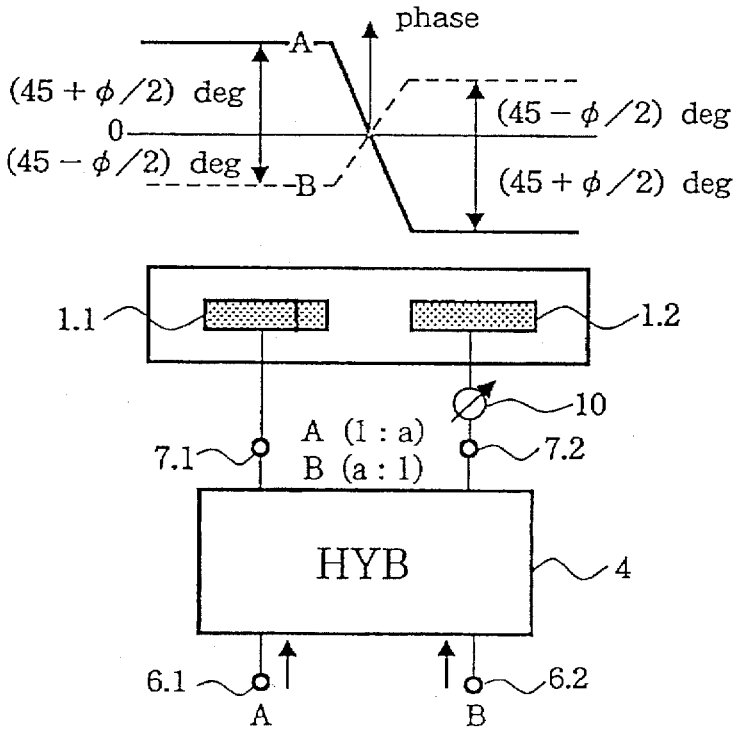
FIG. 17 serves to explain how two beams are formed asymmetrically at a single antenna face.

FIG. 17 serves to explain how two beams are formed asymmetrically at a single antenna face. To form two beams asymmetrically, phase shifter 10 is provided between hybrid circuit 4 and at least one of the two radiators 1.1 and 1.2. In the example shown, phase shifter 10 is provided between hybrid circuit 4 and radiator 1.2. During beam radiation, signal A, which has been input from base station-side terminal 6.1, is divided between antenna-side terminals 7.1 and 7.2 so that the power distribution ratio becomes 1:α. The phase of signal A at antenna-side terminal 7. I will then be 90° ahead of the phase at antenna-side terminal 7.2. Conversely, signal B, which has been input from base station-side terminal 6.2, has a power distribution ratio of a:1 and the phase at antenna-side terminal 7.1 will lag 90° behind the phase at antenna-side terminal 7.2. When phase shifter 10 has been inserted at antenna-side terminal 7.2 and its phase shift is ϕ [degrees], the phase on radiator 1.1 when there is input from base station-side terminal 6.1 will be (90+ϕ)° ahead of the phase on radiator 1.2. Conversely, when there is input from base station-side terminal 6.2, the phase on radiator 1.2 will be (90−ϕ)° ahead of the phase on radiator 1.1.

Under these circumstances, letting the element spacing be d and the wavelength be λ, the power directionality of the antenna shown in FIG. 17 can be given (using a similar equation to Equation 2) by the following equation when radiators 1.1 and 1.2 are non-directive:

$$f(\theta)=2\cos^2\left(\frac{180d}{\lambda}\sin\theta\pm 45-\phi\right) \tag{6}$$

In this equation, an addition on the right-hand side expresses signal B and a subtraction expresses signal A. The angular unit is degrees. In Equation 6, f(θ) becomes maximum at angle $\theta_{max}$ [degrees], at which:

$$\frac{180d}{\lambda}\sin\theta_{max}=\pm 45+\phi \tag{7}$$

From Equation 7, the position of the peak that is inclined from the perpendicular to the antenna face towards radiator 1.2—in other words, the position of the peak $\theta_{max}^{r}$ on the right-hand side in FIG. 17—will be given by:

$$\theta^{r}_{max}=\sin^{-1}\left[\frac{\lambda}{d}\left(\frac{1}{4}+\frac{\phi}{180}\right)\right] \tag{8.1}$$

Likewise, the position of the peak $\theta_{max}^{1}$ that is inclined towards radiator 1.1 will be given by:

$$\theta^{l}_{max}=\sin^{-1}\left[\frac{\lambda}{d}\left(\frac{1}{4}-\frac{\phi}{180}\right)\right] \tag{8.2}$$

The split angle of the two beams, i.e., the angle α between the two main beams, will therefore be given by:

$$\begin{aligned}\alpha &= \theta^{r}_{max}+\theta^{l}_{max} \\ &= \sin^{-1}\left[\frac{\lambda}{d}\left(\frac{1}{4}+\frac{\phi}{180}\right)\right]+\sin^{-1}\left[\frac{\lambda}{d}\left(\frac{1}{4}-\frac{\phi}{180}\right)\right]\end{aligned} \tag{9}$$

If ϕ is small, Equation 9 can be approximated by:

$$\alpha\approx 2\sin^{-1}\left(\frac{\lambda}{4d}\right) \tag{10}$$

This equation is approximately the same as Equation 4. In addition, the deviation angle δ can be obtained on the basis of Equations 8.1 and 8.2, and is given by:

$$\begin{aligned}\delta=\theta^{r}_{max}-\frac{\alpha}{2} &= \sin^{-1}\left[\frac{\lambda}{d}\left(\frac{1}{4}+\frac{\phi}{180}\right)\right]-\sin^{-1}\left(\frac{\lambda}{4d}\right) \\ &\approx \sin^{-1}\left(\frac{\phi\lambda}{180d}\right)\end{aligned} \tag{11}$$

Any given split angle α and deviation angle δ can be set on the basis of Equations 8.1 and 8.2 and Equation 9, by appropriate selection of radiator spacing d and phase shift ϕ [degrees]. Equations 10 and 11 may be used to obtain a rough split angle α and deviation angle δ.

Figure 18:
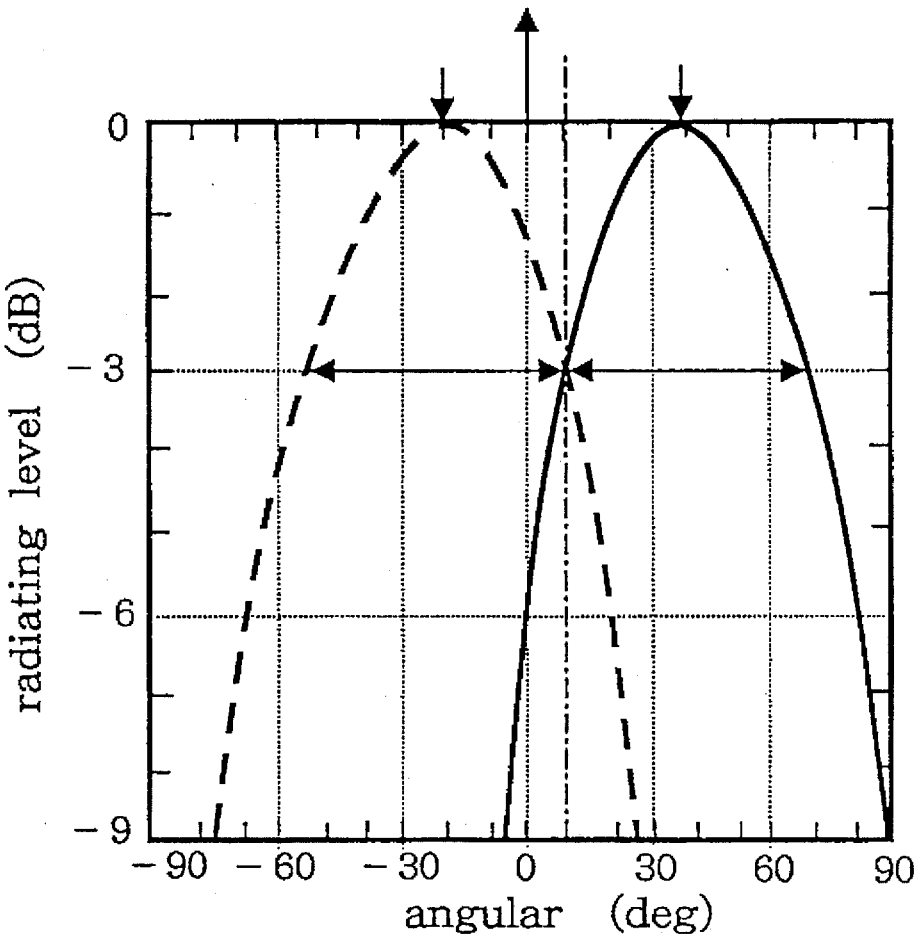
FIG. 18 shows an example of 2-beam radiation directivity in the third embodiment.

FIG. 18 shows an example of 2-beam radiation directivity in the third embodiment. It is assumed here that the power distribution ratio of hybrid circuit 4 is 1:1, the radiator spacing is 0.5 wavelengths, and the 3 dB bandwidth of the radiators is 150°, whereupon it will be seen that the 3 dB bandwidth and the beam split angle both become approximately 60°, and that the deviation angle δ becomes approximately 10°. Thus, by connecting hybrid circuit 4 and phase shifter 10 to two radiators and by making appropriate selection of the radiator spacing, two beams with 3 dB beamwidths which are approximately equal to the beam split angle can be formed with an inclination at any desired deviation angle. Four beams with equal spacing can be formed by using such an antenna as one face and arranging two such faces at the split angle given in Equation 5.

If the 3 dB beamwidth of radiators 1 were narrower, the split angle, 3 dB beamwidth and deviation angle of the beams of a two-element array antenna would become slightly smaller than the value given by Equations 8.1, 8,2 and 9. In this case, the beam split angle could be adjusted to the desired value by altering the radiator spacing and the power distribution ratio of hybrid circuit 4.

Figure 19:
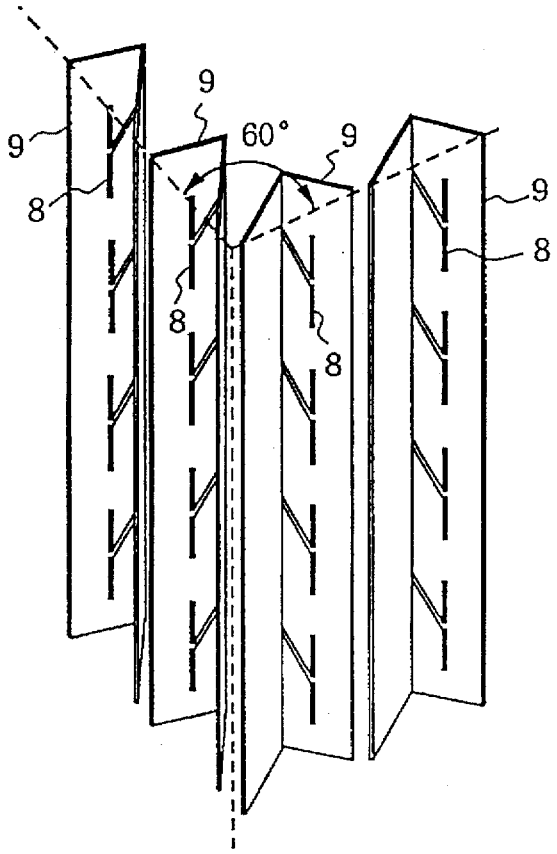
FIG. 19 is a perspective view showing the constitution of a fourth embodiment of this invention.
Figure 20:
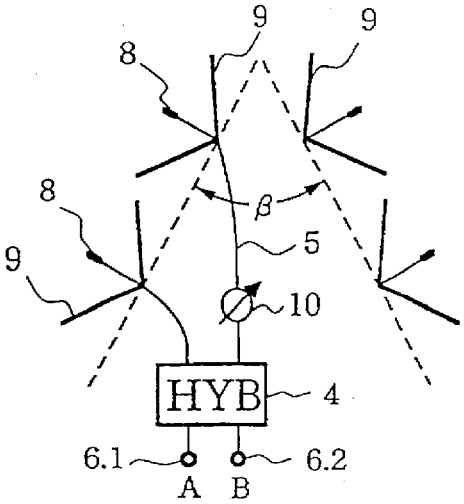
FIG. 20 is a cross-sectional view of the fourth embodiment.

FIG. 19 is a perspective view showing the constitution of a fourth embodiment of this invention, and FIG. 20 is the corresponding cross-sectional view.

This embodiment is one which uses dipole antennas fitted with reflectors as the radiators, and its constitution is similar to that of the second embodiment. That is to say, dipole antennas 8 are fitted in a line to reflector 9, and two such assemblies comprise an antenna element. These antenna elements are arranged so that the split angle β of the antenna faces is 60°, for example. The operation of this embodiment is the same as that of the third embodiment. That is to say, four equally-spaced beams are formed by using hybrid circuit 4 and phase shifter 10 to combine two reflector-fitted dipole array antennas that face in the same direction, and then employing this assembly on two faces.

Figure 21:
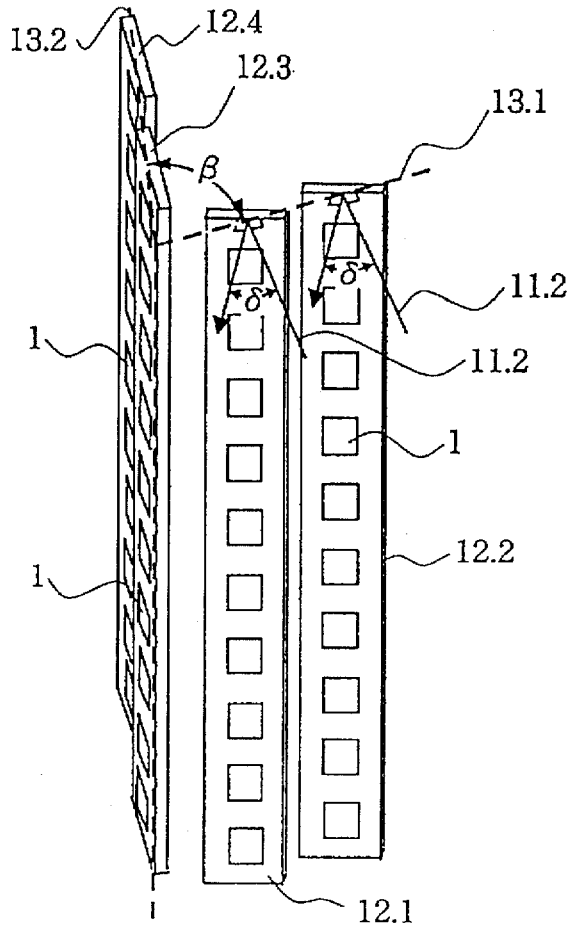
FIG. 21 is a perspective view showing the constitution of a fifth embodiment of this invention.
Figure 22:
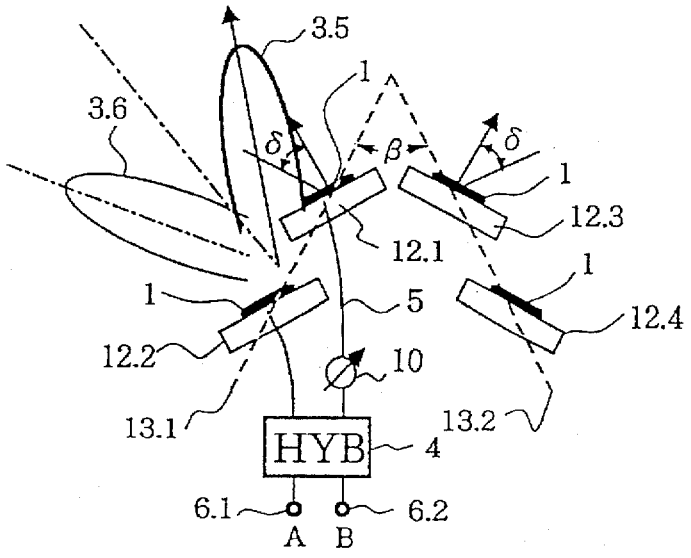
FIG. 22 shows the cross-section and main beam radiation pattern of the fifth embodiment.

FIG. 21 is a perspective view showing the constitution of a fifth embodiment of this invention, while FIG. 22 shows its cross-section and main beam radiation pattern.

This embodiment is one where the antenna faces in the third embodiment shown in FIG. 15 have been divided vertically into two, and the center points of radiator faces 12.1–12.4 have been arranged so as to lie on antenna faces 13.1 and 13.2.

In the third embodiment shown in FIG. 15 and FIG. 16, if the deviation angle δ is large, the gain of main beam 3.3, the beam which points away from the perpendicular to the antenna element on the same side as the deviation, will greatly decrease. This is because, due to the directivity of radiators 1, the radiating level drops along the directions which are ±90° relative to perpendicular 11.1. In the fifth embodiment, therefore, radiator faces 12.1–12.4 are arranged at a slant so that the directions of the main beams of radiator faces 12.1–12.4 deviate by δ [degrees] horizontally with respect to perpendicular 11.2 from antenna face 13.1. By adopting this arrangement, the direction in which the directivity of radiators 1 is maximum will be inclined over to the main beam 3.5 side, and therefore the gain of main beam 3.5 is improved, so that the gains of main beams 3.5 and 3.6 become approximately equal.

When the direction of radiators 1 has been made to deviate in this way, four beams radiating at equiangular intervals can be obtained by arranging two antenna faces 13.1 and 13.2 so that they are opened at an angle β, where this split angle β is set so that:

$$\beta=180-2(\alpha+\delta)$$

Figure 23:
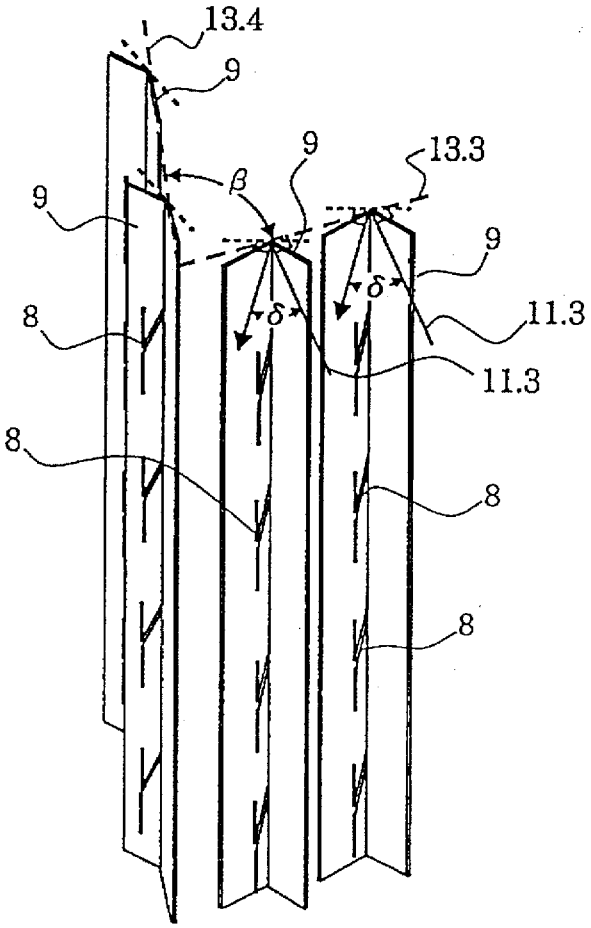
FIG. 23 is a perspective view showing the constitution of a sixth embodiment of this invention.
Figure 24:
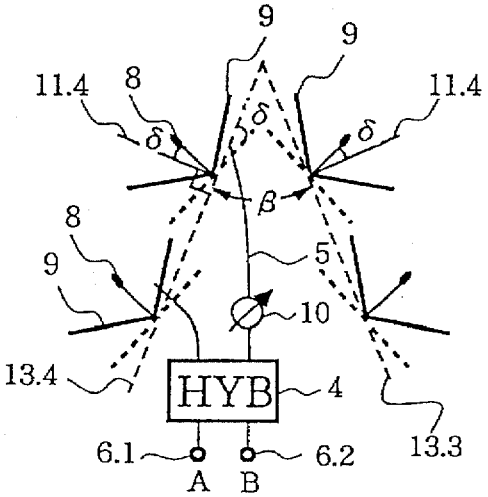
FIG. 24 is a cross-sectional view of the sixth embodiment.

FIG. 23 is a perspective view showing the constitution of a sixth embodiment of this invention, while FIG. 24 is the corresponding cross-sectional view. This embodiment differs from the fifth embodiment in that dipole antennas fitted with reflectors have been used as the radiators. That is to say, dipole antennas 8 are fitted in a line to reflector 9, and two such assemblies comprise an antenna element. The direction of the main beam resulting from dipole antennas 8 and reflector 9 is arranged so that it deviates horizontally by an angle δ from perpendiculars 11.3 and 11.4 to antenna faces 13.3 and 13.4.

Figure 25:
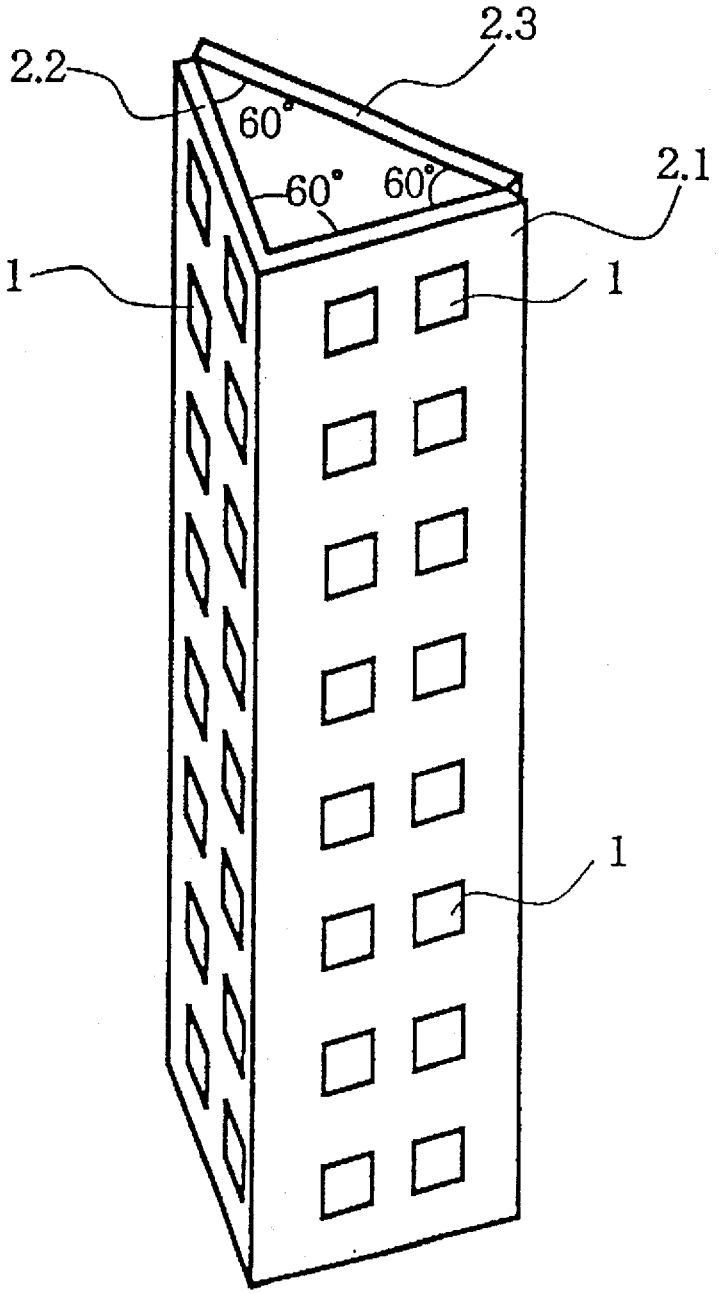
FIG. 25 is a perspective view showing the constitution of a seventh embodiment of this invention.
Figure 26:
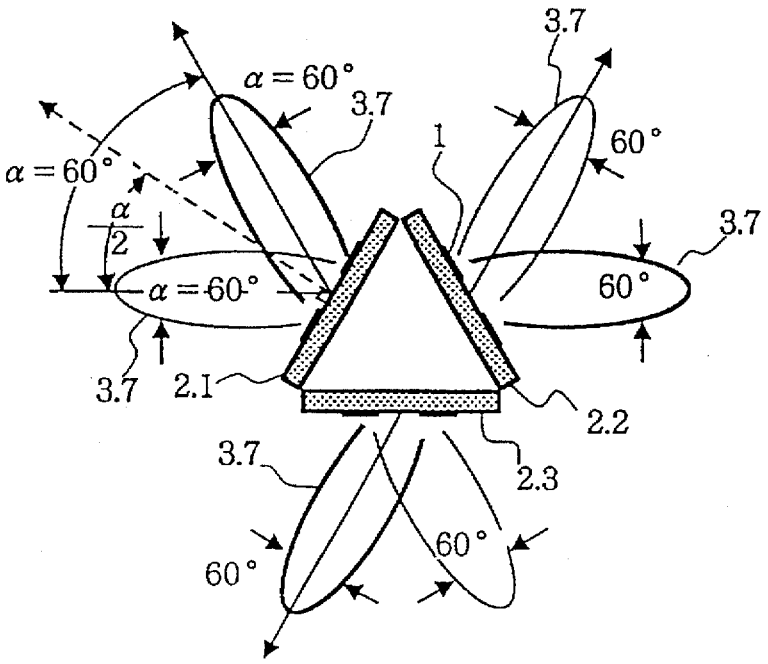
FIG. 26 shows the cross-section and main beam radiation pattern of the seventh embodiment.

FIG. 25 is a perspective view showing the constitution of a seventh embodiment of this invention, and FIG. 26 shows its cross-section and main beam radiation pattern.

This embodiment differs from the embodiments described above in that an antenna element is provided on each side of a regular triangle. That is to say, antenna elements which generate two main beams 3.7 such that the angle between them is smaller than 180° are provided on each face of a regular triangle, and these antenna elements comprise a plurality of radiators 1 arranged on antenna faces 2.1, 2.2 and 2.3. Planar antennas such as patch antennas or slot antennas are used as radiators 1, and main beams 3.7 are radiated from antenna faces 2.1, 2.2 and 2.3. The split angle between the centers of each two beams is set so that α=60°.

In general, in order to arrange 2 n beams at equal intervals by setting up n 2-beam antennas facing outwards in positions on each side of a regular n-sided polygon, it is necessary to set the split angle α of the two beams associated with each face to the value given by the following equation:

$$\alpha=\frac{180}{n} \tag{12}$$

where n is an integer equal to or greater than 2.

In the embodiment shown in FIG. 25 and FIG. 26, because n=3, α=180/3 =60°, and the split angle α of adjacent array antennas is made 60°. As was explained with regard to the first embodiment, this sort of directivity can be achieved by arranging two radiators 1 at a spacing of 0.5 wavelengths, and combining said radiators by hybrid circuit 4. As was explained with regard to the first embodiment, the relation between beam split angle α and radiator spacing d is given by Equation 4. When 2 n beams are arranged by means of 2-beam antennas based on hybrid combination, the spacing d between the two radiators at each antenna face is found, from Equations 4 and 12, to be:

$$d=\frac{\lambda}{4\sin(180/2n)} \tag{13}$$

In practice, radiators 1 have directivity towards the front, and the beam split angle will be somewhat smaller than the value given by Equation 4. In this case, the beam split angle α can be adjusted to the desired value by altering the radiator spacing and/or the power distribution ratio of hybrid circuit 4.

Figure 27:
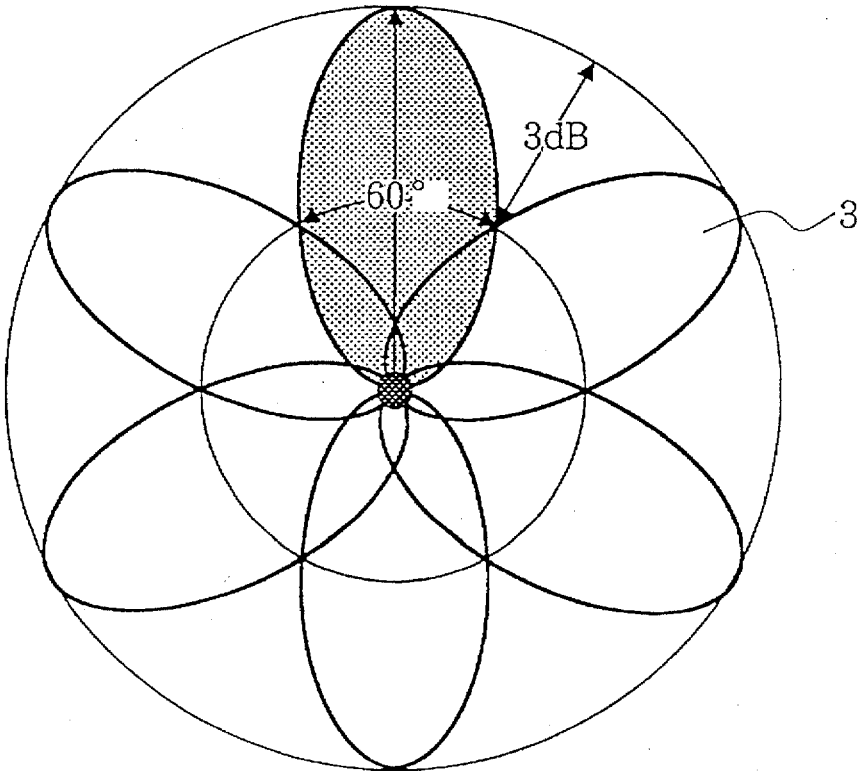
FIG. 27 shows the directivity obtained in the horizontal plane with the seventh embodiment.

FIG. 27 shows the directivity in the horizontal plane in the seventh embodiment. By using this sort of antenna, a single zone can be divided equally into six sector zones.

Figure 28:
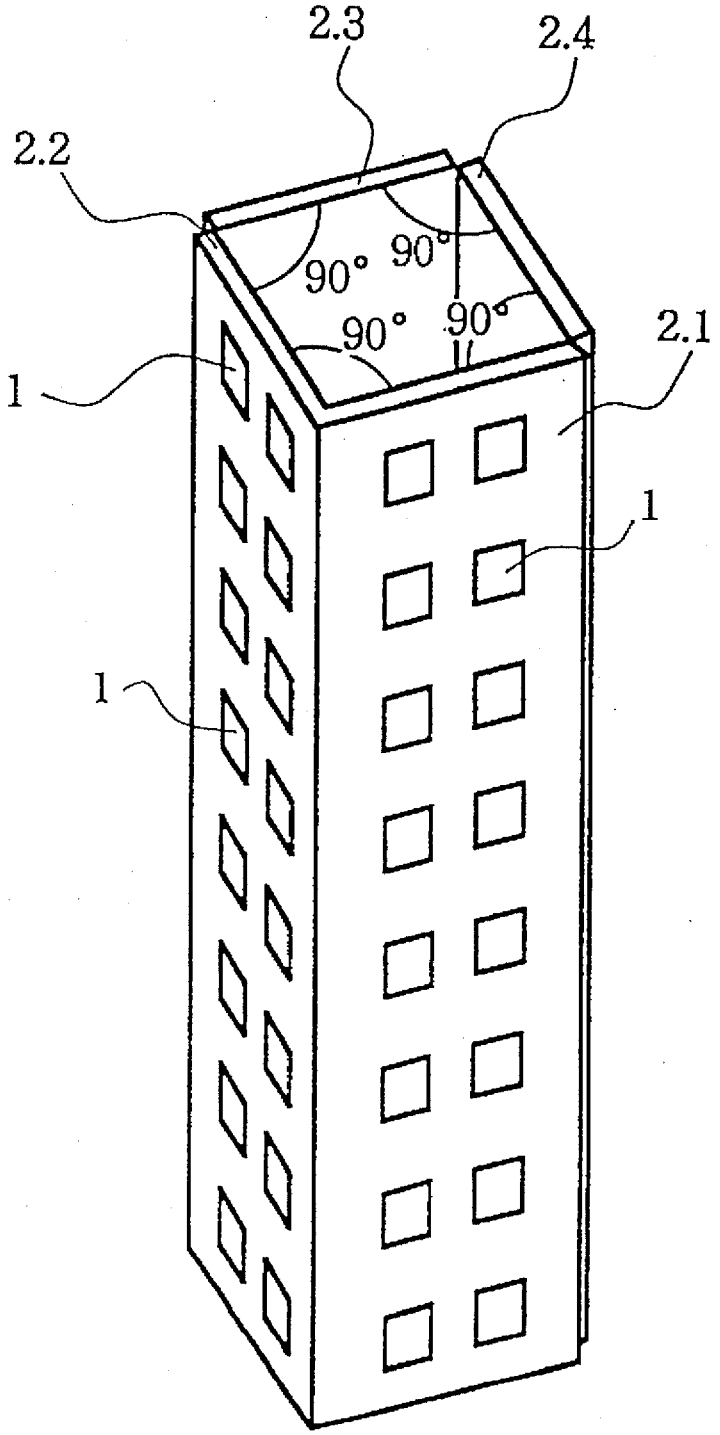
FIG. 28 is a perspective view showing the constitution of an eighth embodiment of this invention.
Figure 29:
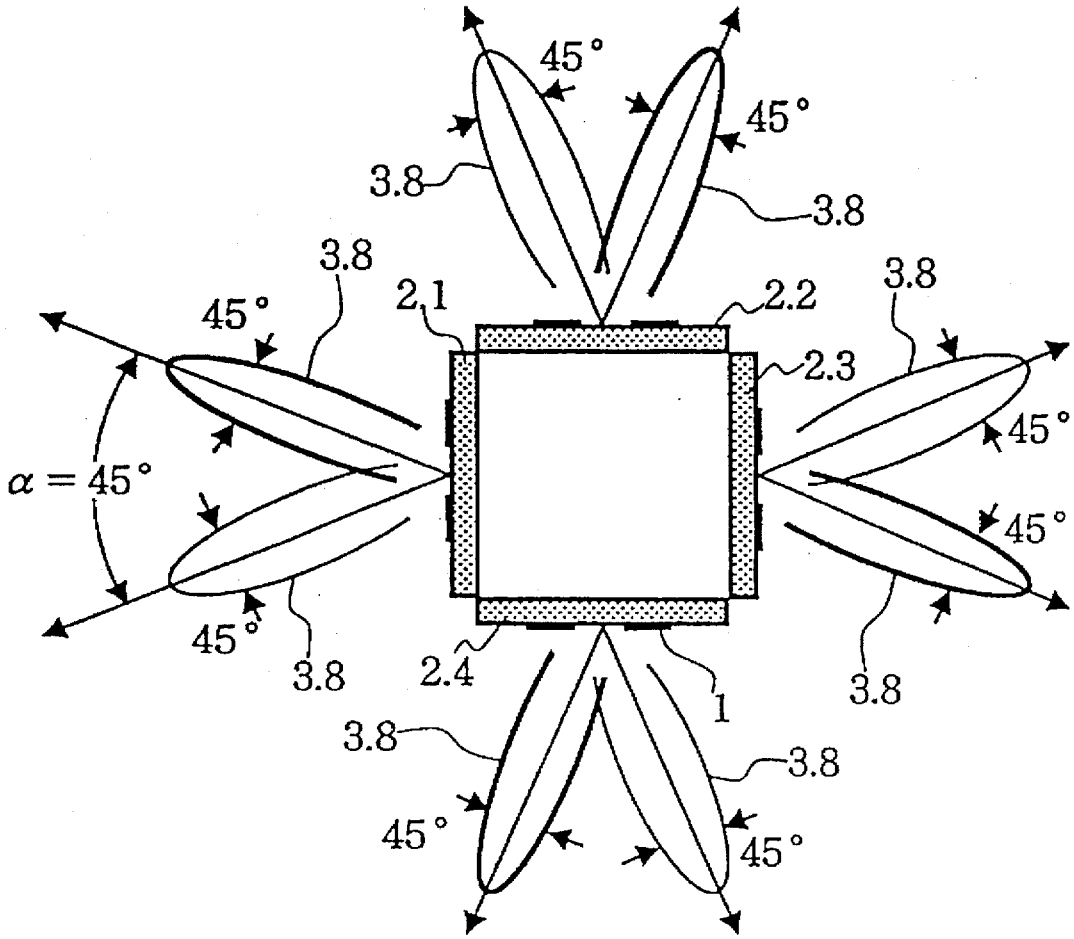
FIG. 29 shows the cross-section and main beam radiation pattern of the eighth embodiment.

FIG. 28 is a perspective view showing the constitution of an eighth embodiment of this invention, while FIG. 29 shows the corresponding cross-section and main beam radiation pattern.

This embodiment is one in which an antenna element that generates two main beams 3.8 such that the angle between these beams is smaller than 180°, is provided at a position corresponding to each side of a square, and these antenna elements each comprise radiators 1 arranged respectively on antenna faces 2.1, 2.2, 2.3 and 2.4. The rest of the constitution is similar to the seventh embodiment. In this example, eight main beams 3.8 are formed, and the angle α between two adjacent main beams 3.8 is set so that α=180/4=45 [degrees]. The 3 dB bandwidth of each main beam 3.8 is also 45°.

Figure 30:
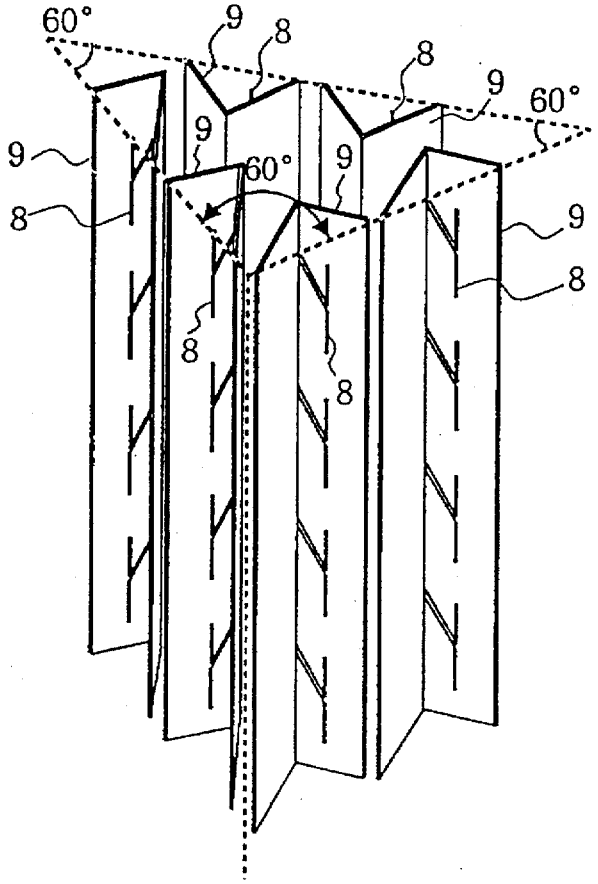
FIG. 30 is a perspective view showing the constitution of a ninth embodiment of this invention.
Figure 31:
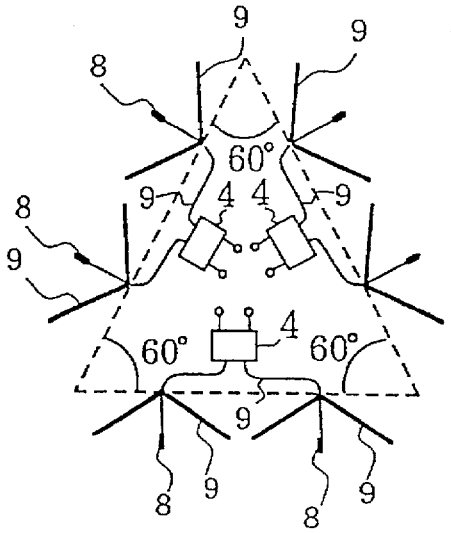
FIG. 31 shows the internal constitution of the ninth embodiment.

FIG. 30 is a perspective view showing the constitution of a ninth embodiment of this invention, and FIG. 31 shows its internal constitution.

This embodiment is constituted by fitting dipole antennas 8 to reflector 9, arranging two such assemblies at positions corresponding to each side of a regular triangle, and connecting hybrid circuit 4 to each antenna element formed from said two assemblies. In virtue of this constitution, six beams can be formed in similar manner to embodiment 7 illustrated in FIG. 25 and FIG. 26.

The explanations given in the foregoing embodiments presupposed that the tilt angle $\theta_t$ of a beam in the vertical plane was zero, or in other words, that the beams are formed in a horizontal direction. If it is necessary that tilt angle $\theta_t \neq 0$, the antenna elements that are used will each be able to form two directional beams and also to vary the tilt angle $\theta_t$ of the beams. Examples of such antenna elements will be explained below.

Figure 32:
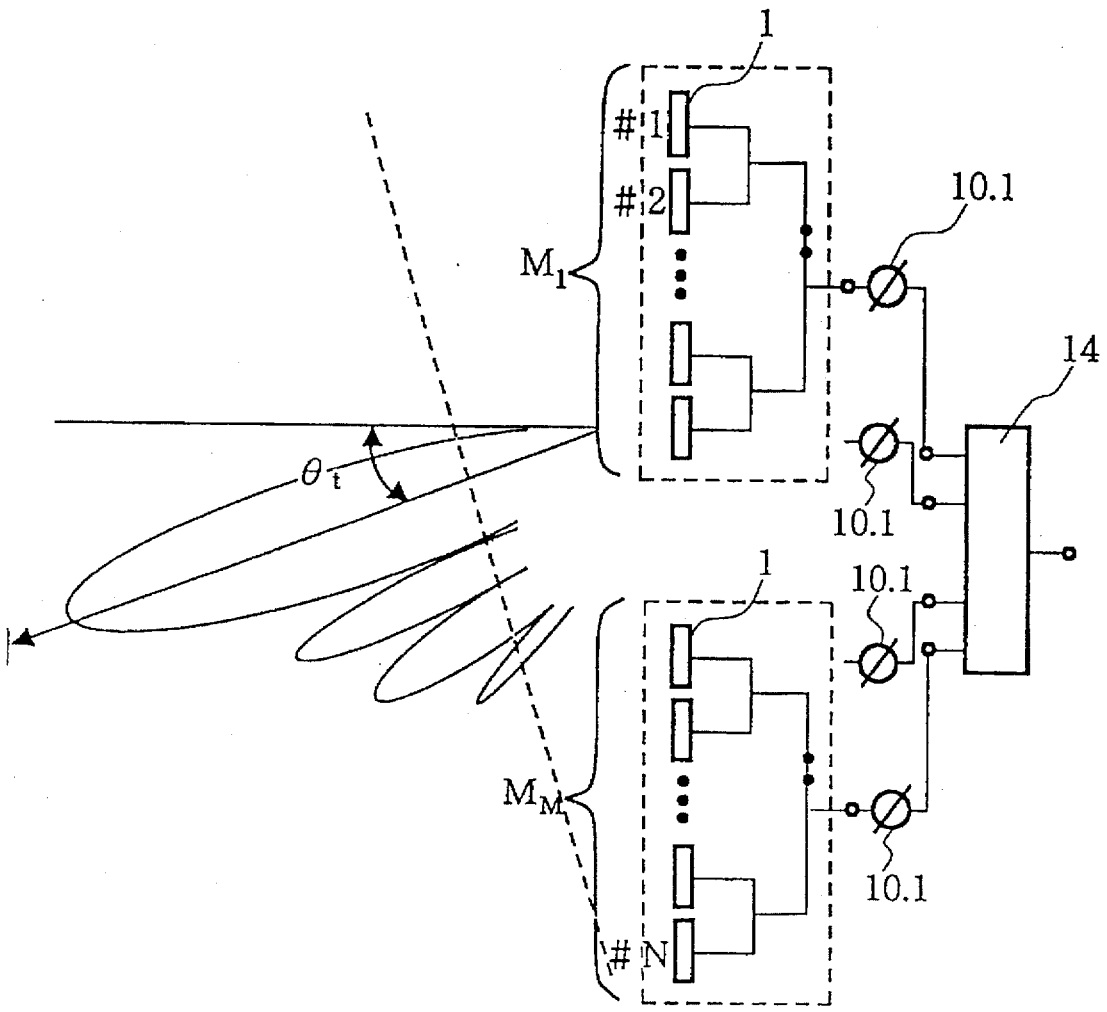
FIG. 32 is a block diagram showing a well-known antenna element with which the tilt angle of a beam can be adjusted.

FIG. 32 is a block diagram showing a well-known antenna element whereby the tilt angle of a beam can be varied. This antenna element was disclosed in Japanese Pat. Pub. No. 61-172411, and is constituted by dividing an array antenna into M blocks, the array antenna comprising a plural number N of radiators 1 arranged in one line in a vertical plane, and the blocks respectively comprising $M_1, \ldots, M_M$ radiators. For each block, these radiators 1 are connected via phase shifter 10.1 to feed circuit 14. Given this constitution, by altering the value of the phase shifters 10.1 which are connected to the respective blocks, the excitation phase on radiators 1 can be altered and the beam direction set as desired.

Figure 33:
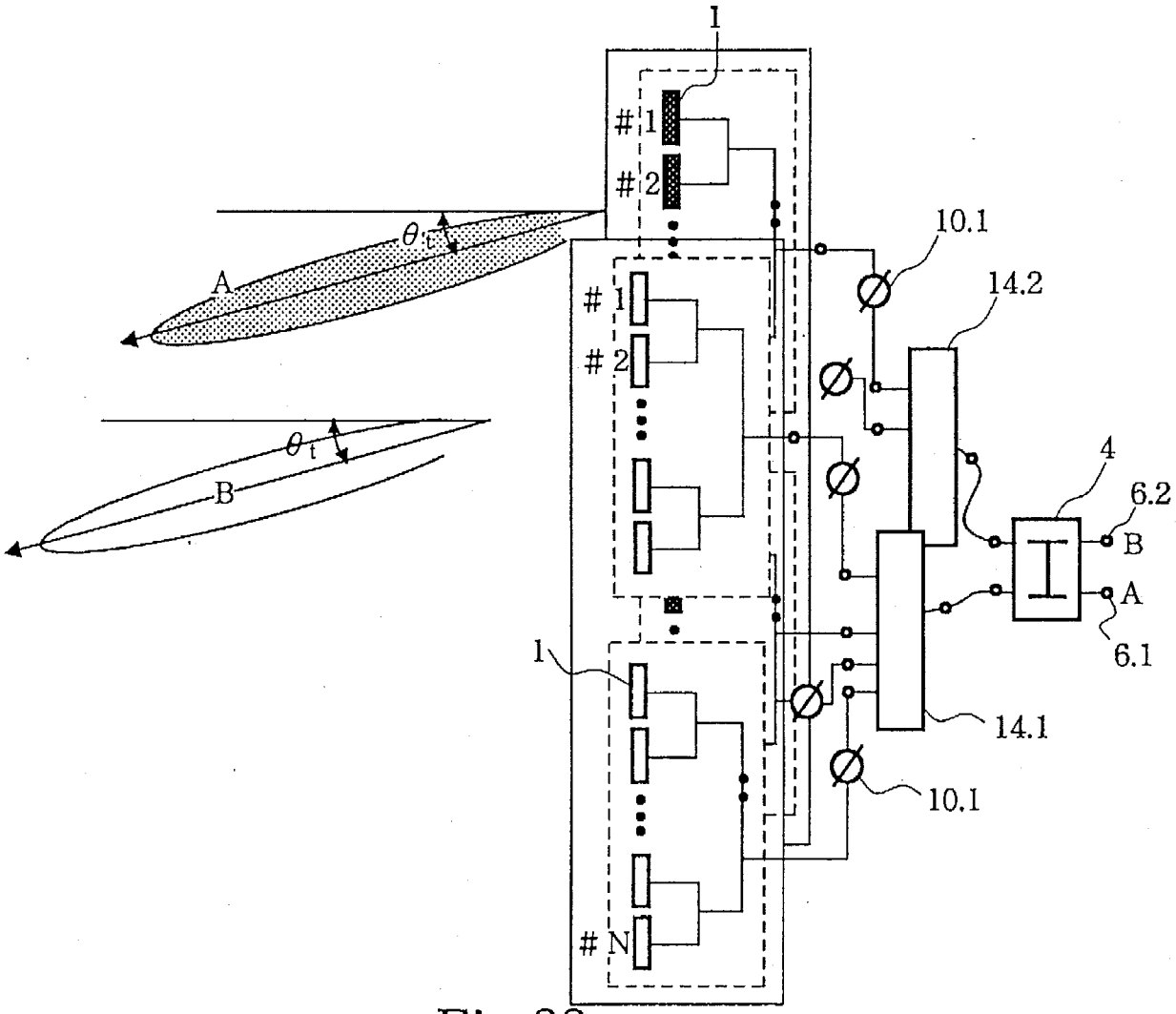
FIG. 33 shows an example of a constitution where the antenna element illustrated in FIG. 32 is utilized in the present invention.

FIG. 33 gives an example of a constitution where the antenna element shown in FIG. 32 is utilized in the present invention. In this example, two of the antenna elements shown in FIG. 32 have been placed side by side and connected to hybrid circuit 4. By virtue of this constitution, it becomes possible to form two directional beams with a variable tilt angle.

However, when two beams are generated by means of this sort of constitution, the tilt angles of the two array antennas within a vertical plane will be the same for the two main beams, and it is therefore impossible to alter the vertical tilt angles of the two beams independently. An example of a constitution which enables the tilt angles of two beams to be altered independently will be disclosed below.

Figure 34:
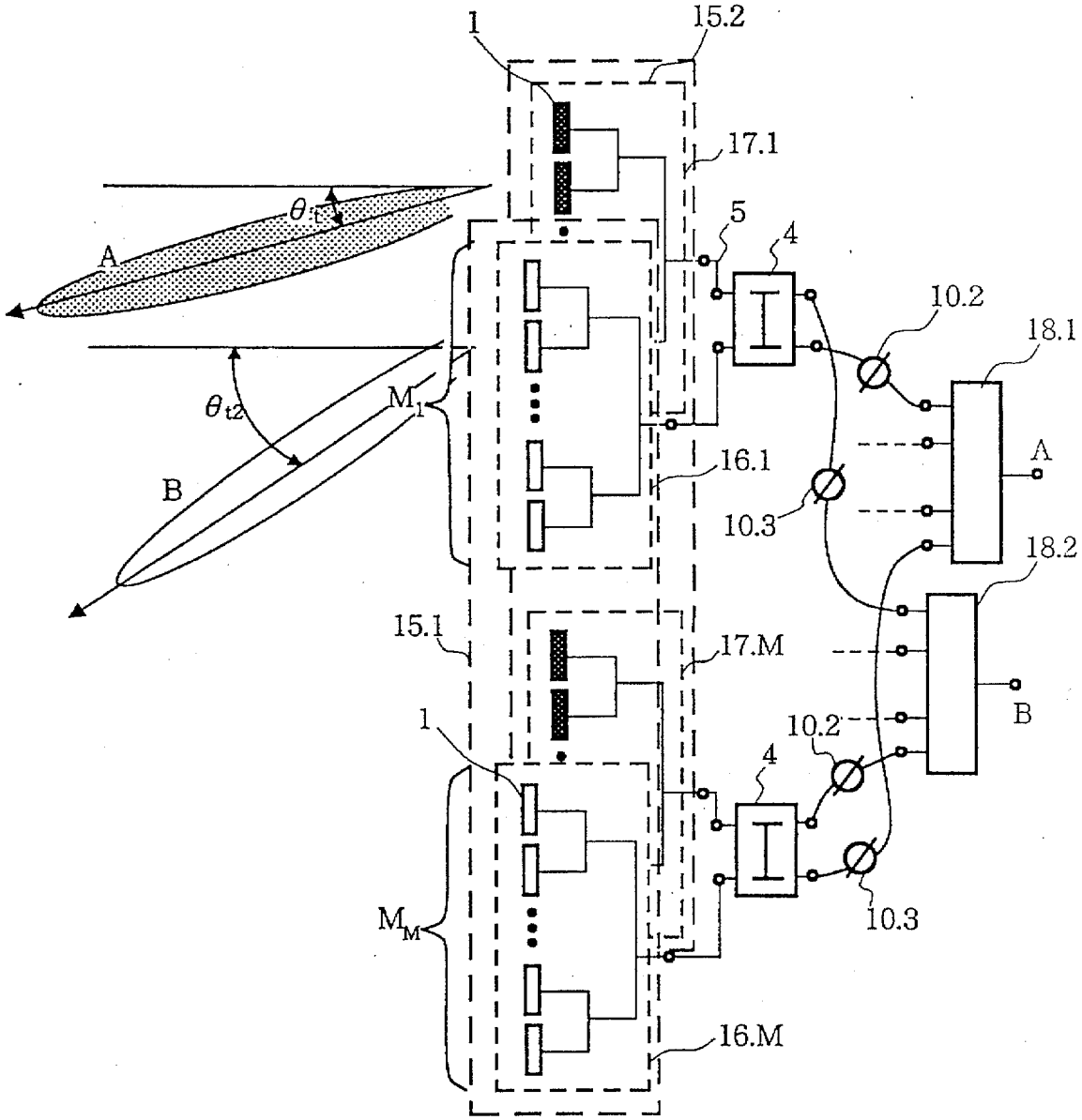
FIG. 34 is a block diagram showing the constitution and main beam radiation pattern of an antenna element.
Figure 35:
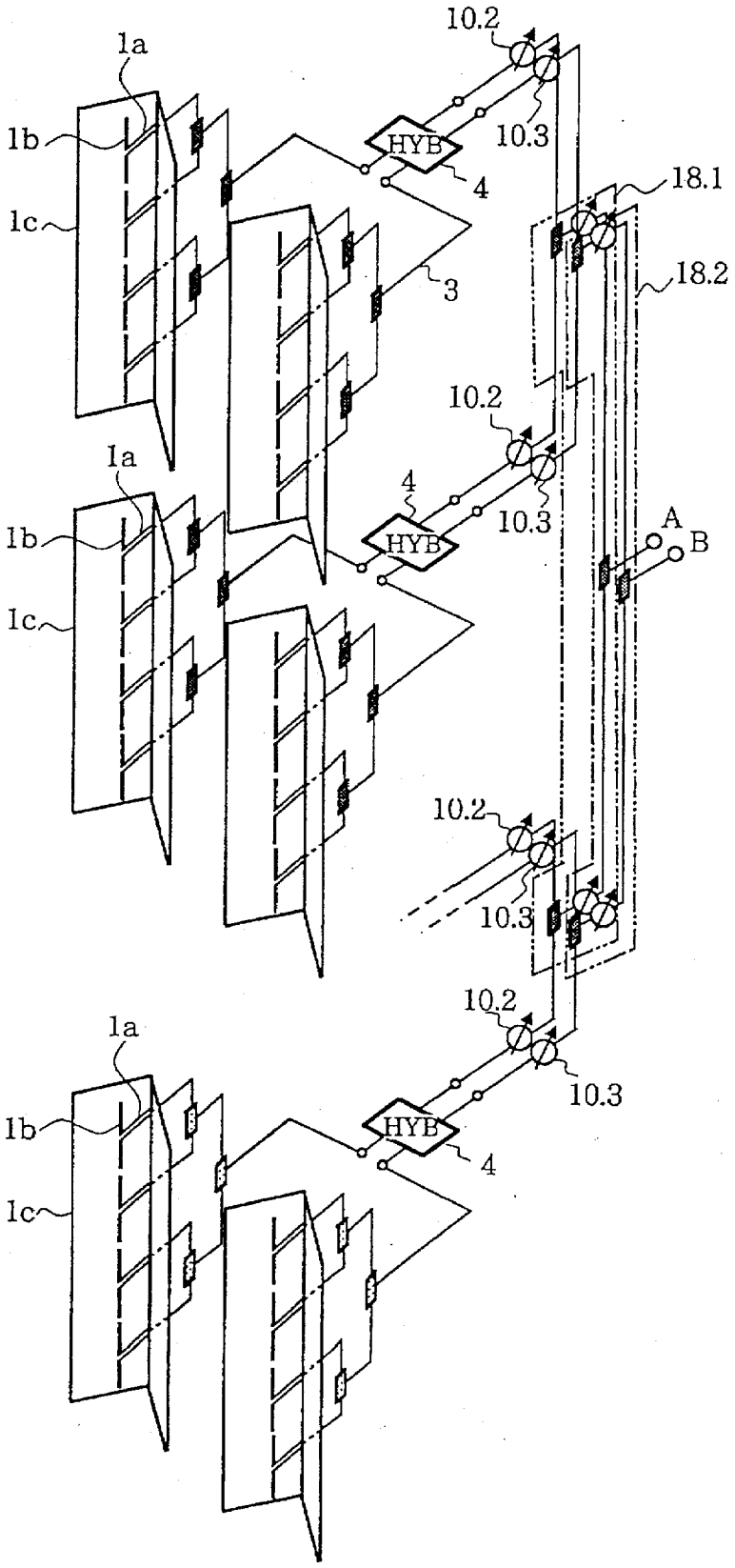
FIG. 35 is a perspective view showing a specific constitution.

FIG. 34 is a block diagram showing an example of the constitution of an antenna element and the main beam radiation pattern, while FIG. 35 is a perspective view showing a more specific constitution.

In this antenna element, first array antenna 15.1 comprising N vertically arrayed radiators 1 (where N is an integer equal to or greater than 2) and second array antenna 15.2 with approximately the same constitution as this first array antenna 15.1, are arranged so as to be adjacent to one another. Array antennas 15.1 and 15.2 are respectively divided into M blocks 16.1–16.M and 17.1–17.M (where M is an integer such that $2 \leqq M \leqq N$) and there is provided a plural number M of hybrid circuits 4. These hybrid circuits 4 each contain a first and a second antenna-side terminal and a first and a second base station-side terminal, and have directional coupling characteristics such that the respective signals at the base station-side terminals of the hybrid circuit become 90° out-of-phase signals at the two antenna-side terminals. There are also provided M first phase shifters 10.2, M second phase shifters 10.3, and first and second power dividers 18.1 and 18.2 which respectively have M terminals on the antenna side and one input terminal on the base station side. Radiators 1 of two horizontally adjacent blocks 16.i and 17.i (where i=1–M) of first and second array antennas 15.1 and 15.2 are respectively connected to the first and second antenna-side terminals of hybrid circuit 4 which corresponds to the block in question. The first base station-side terminals of the M hybrid circuits 4 are respectively connected via first phase shifters 10.2 to first power divider 18.1, while the second base station-side terminals of the M hybrid circuits 4 are respectively connected via second phase shifters 10.3 to second power divider 18.2.

Dipole antennas 1*b* connected to feeders 1*a* can for example be used, as shown in FIG. 35, as radiators 1*b*, and reflectors 1*c* can be arranged behind these.

Thus, in terms of overall constitution, the antenna elements shown in FIG. 34 and FIG. 35 comprise array antennas 15.1 and 15.2 arranged side by side, said array antennas each having N radiators 1 arranged in a vertical line. In each block, adjoining radiators 1 to the right and the left are connected to the two antenna-side terminals of a hybrid circuit 4. Of the two base station-side terminals of the hybrid circuit 4 provided for each block, in each case one is connected to power divider 18.1 via a phase shifter 10.2, while the other is connected to power divider 18.2 via a phase shifter 10.3. If these phase shifters 10.2 and 10.3 are set so that a beam tilt angle of $\theta_{t1}$ is obtained, the excitation phase distribution of right and left array antennas 15.1 and 15.2 will become exactly the same, and beam A with tilt angle $\theta_{t1}$ will be formed. Thus, beam A is dependent only on phase shifters 10.2 and power divider 18.1, and therefore only the values of phase shifters 10.2 need be altered if it is desired to change the beam tilt angle of beam A only. Under these circumstances, the tilt angle of beam B will not change. Likewise, the tilt angle of beam B alone can be altered by changing the value of phase shifters 10.3.

Figure 36:
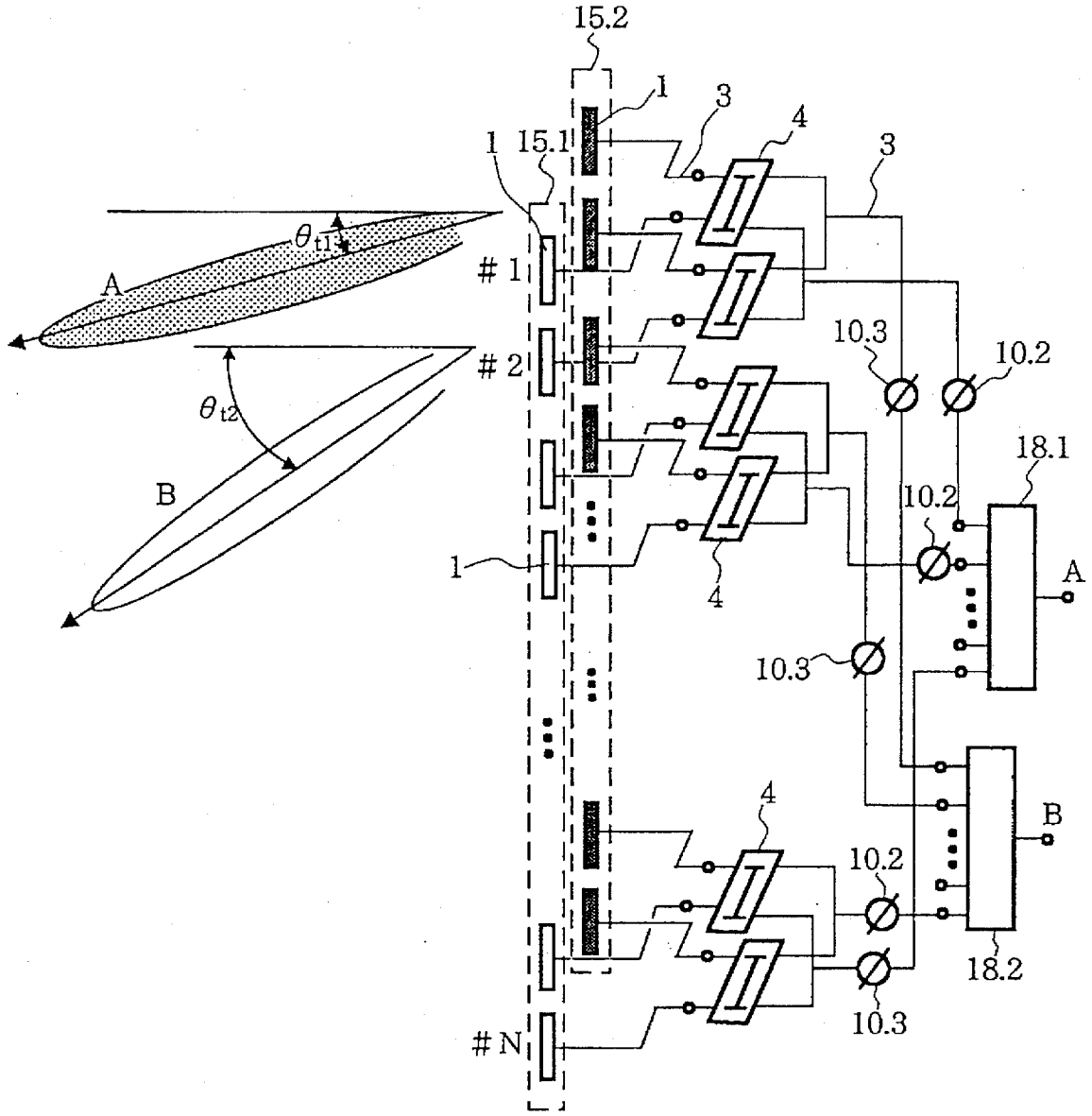
FIG. 36 is a block diagram showing another example of the constitution of an antenna element and the main beam radiation pattern.

FIG. 36 is a block diagram which shows an example of another constitution for an antenna element, and which indicates the main beam radiation pattern.

In this example, first array antenna 15.1 comprising N vertically arrayed radiators 1 (where N is an even number equal to or greater than 2) and second array antenna 15.2 with approximately the same constitution as this first array antenna 15.1, are arranged so as to be adjacent to one another. Array antennas 15.1 and 15.2 are each divided into M blocks (where M is an even number such that $2 \leqq M \leqq N$) and there is provided a plurality of hybrid circuits 4. These hybrid circuits 4 each contain a first and a second antenna-side terminal and a first and a second base station-side terminal, and have directional coupling characteristics such that the respective signals at the base station-side terminals of the hybrid circuit become 90° out-of-phase signals at the two antenna-side terminals. There are also provided a plurality of first phase shifters 10.2, a plurality of second phase shifters 10.3, and first and second power dividers 18.1 and 18.2, each of which has a plurality of terminals on the antenna side and one terminal on the base station side. Horizontally adjacent radiators 1 of first and second array antennas 15.1 and 15.2 are respectively connected to the first and second antenna-side terminals of the corresponding hybrid circuit 4. The first base station-side terminals of hybrid circuits 4 pertaining to the same block are joined together and then connected via a first phase shifter 10.2 to first power divider 18.1, while the second base station-side terminals of hybrid circuits 4 pertaining to the same block are joined together and then connected via a second phase shifter 10.3 to second power divider 18.2.

Thus, in terms of overall constitution, this antenna element comprises array antennas 15.1 and 15.2 arranged side by side, each array antenna having N radiators 1 arranged in a vertical line. The terminals of adjacent radiators 1 to the right and the left are connected to the two antenna-side terminals of a hybrid circuit 4. Of the two base station-side terminals of hybrid circuits 4, all the right-hand side terminals are connected to power divider 18.1 and all the left-hand side terminals are connected to power divider 18.2. Because phase shifters 10.2 and 10.3 are connected between the base station-side terminals of hybrid circuits 4 and power dividers 18.1 and 18.2 respectively, the principles involved in altering main beams A and B separately are the same as in the examples shown in FIG. 34 and FIG. 35, and the same effect can be obtained.

Figure 37:
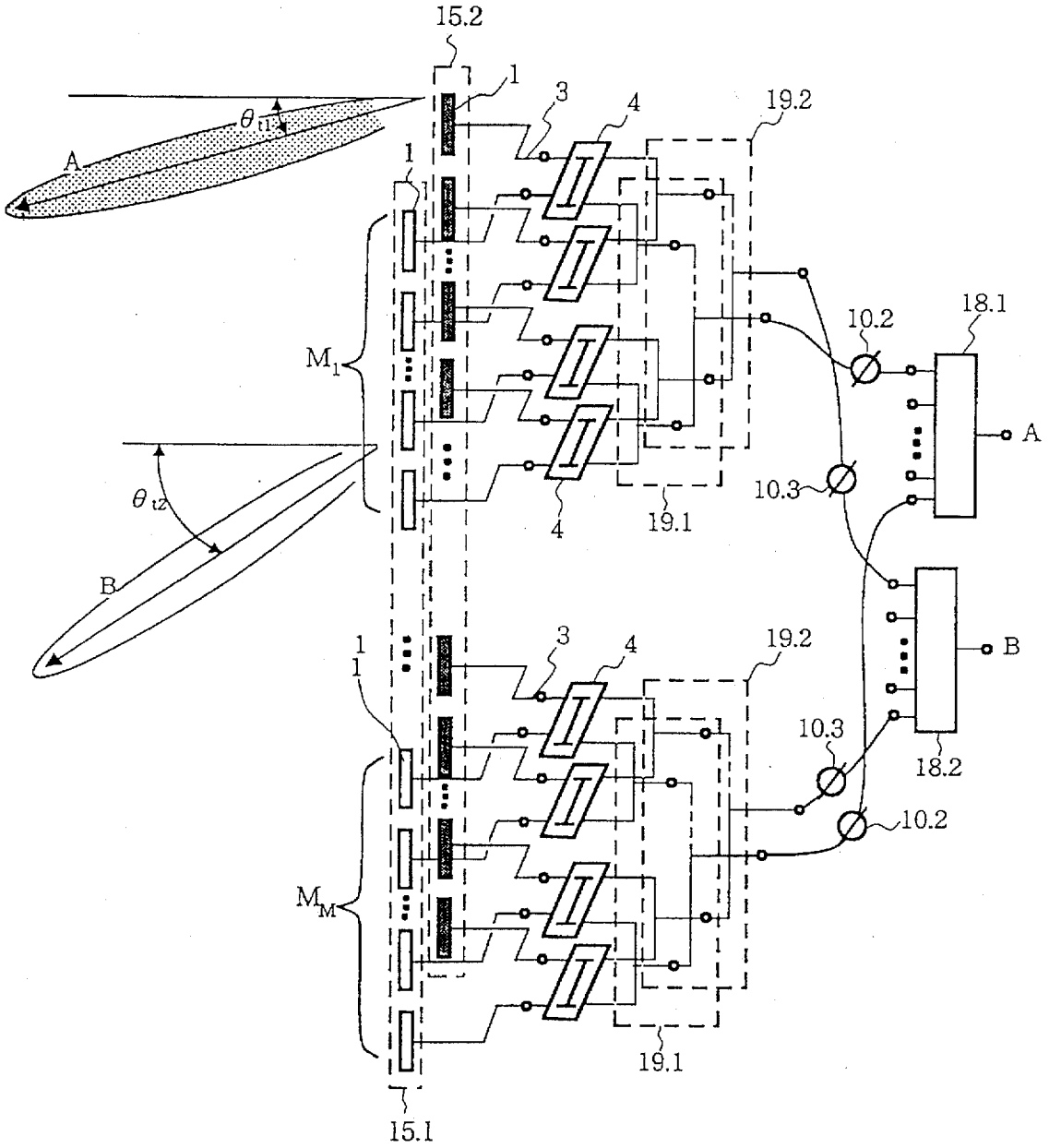
FIG. 37 is a block diagram showing another example of the constitution of an antenna element and the main beam radiation pattern.

FIG. 37 is a block diagram which shows an example of another constitution for an antenna element, and which indicates the main beam radiation pattern.

This antenna element has the following constitution. First array antenna 15.1 comprising N vertically arrayed radiators 1 (where N is an integer equal to or greater than 2) and second array antenna 15.2 with approximately the same constitution as this first array antenna 15.1, are arranged so as to be adjacent to one another. Array antennas 15.1 and 15.2 are respectively divided into M blocks (where M is an even number such that $2 \leqq M \leqq N$). There is provided a plurality of hybrid circuits 4. Each hybrid circuit 4 contains a first and a second antenna-side terminal and a first and a second base station-side terminal, and has directional coupling characteristics such that the respective signals at the base station-side terminals of the hybrid circuit become 90° out-of-phase signals at the two antenna-side terminals. There are also provided a plurality of first phase shifters 10.2, a plurality of second phase shifters 10.3, first and second power dividers 18.1 and 18.2, each of which has a plurality of terminals on the antenna side and one terminal on the base station side, and M third and M fourth power dividers 19.1 and 19.2, each of which has a plurality of terminals on the antenna side and one terminal on the base station side. Two horizontally adjacent radiators 1 of first and second array antennas 15.1 and 15.2 are respectively connected to the first and second antenna-side terminals of corresponding hybrid circuit 4. The first base station-side terminals of hybrid circuits 4 pertaining to the same block are respectively connected to antenna-side terminals of a third power divider 19.1, while each second base station-side terminal is connected to an antenna-side terminal of a fourth power divider 19.2. The base station-side terminals of these third and fourth power dividers 19.1 and 19.2 are respectively connected via a first and a second phase shifter 10.2 and 10.3 to first and second power dividers 18.1 and 18.2.

Thus, in terms of overall constitution, this antenna element comprises array antennas 15.1 and 15.2 arranged side by side, each array antenna having N radiators 1 arranged in a vertical line. Array antennas 15.1 and 15.2 are each divided into M blocks (where $M<N$) which respectively accommodate $M_1$, $M_2$, . . . $M_M$ radiators 1. For each block, the terminals of adjacent radiators 1 to the right and left are connected to the two input terminals of a corresponding hybrid circuit 4, which has two base station-side terminals. Of these two output terminals, all those on the one side within each block are connected to one intra-block power divider 19.1, while all those on the other side are connected to the other intra-block power divider 19.2. Furthermore, of intra-block power dividers 19.1 and 19.2, all those on one side are combined by one inter-block power divider 18.1, while all those on the other side are combined by the other inter-block power divider 18.2. Phase shifters 10.2 and 10.3 are respectively connected between the base station-side terminals of intra-block power dividers 19.1 and 19.2 and inter-block power dividers 18.1 and 18.2.

Given this sort of circuit constitution, if the values of phase shifters 10.2 are set so that a beam fit angle of $\theta_{t1}$ is obtained, the fed power will be distributed in identical manner to right and left radiators 1 via intra-block power dividers 19.1 and hybrid circuits 4, and therefore right and left array antennas 15.1 and 15.2 will have the same excitation phase distribution. This results in beam A with, tilt angle $\theta_{t1}$ being formed. Thus, exactly as in the examples given in FIG. 34 and FIG. 35, beam A is dependent only on power divider 18.1, phase shifters 10.2, and power dividers 19.1, and only the values of phase shifters 10.2 need be altered when it is desired to change the beam tilt angle of beam A only. Under these circumstances, the tilt angle of beam B will not change. Likewise, the tilt angle of beam B alone can be changed by altering the phase shift applied by phase shifters 10.3.

Thus, by adjusting the phase shifters placed between respective intra block power dividers and the output terminals on the same side of the hybrid circuits, two beams mutually separated in a horizontal plane can be formed and independent vertical tilt angles can be given to these two beams. Furthermore, if a single array antenna is subdivided into a plurality of elements, it becomes possible to alter beam tilt angles individually, which means that zone shape can be formed with precision. Radio wave utilization efficiency therefore improves and channel capacity in mobile communications can be greatly increased.

Figure 38:
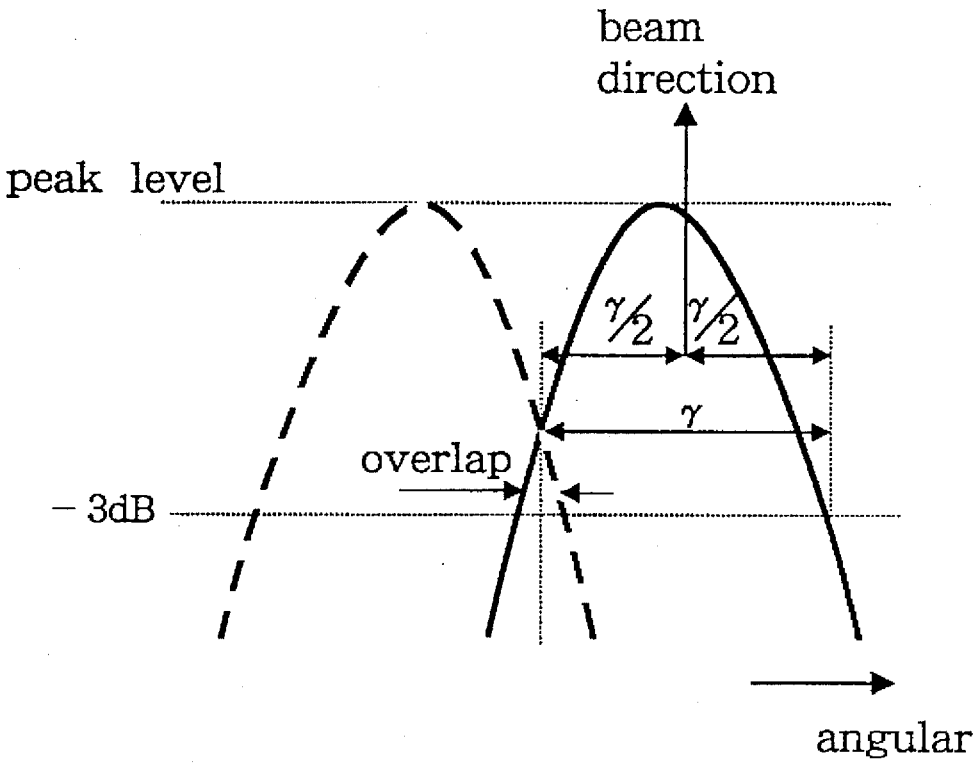
FIG. 38 serves to explain the relation between main beam direction and 3 dB beamwidth.

FIG. 38 serves to explain the relation between the direction of the two main beams and the 3 dB beamwidth. When there is an overlap in the two main beams formed by a single antenna element, the 3 dB beamwidth $\gamma$ of each beam is defined as the angular range from the center point of the two beams to the −3 dB point in the opposite direction on the other side of the peak point. The direction of a main beam then becomes the direction of the center of the 3 dB beamwidth $\gamma$. In this case, therefore, the relation between the angle $\alpha$ between the two main beams and the 3 dB beamwidth $\gamma$ is always:

$$\alpha=\gamma$$

It follows that in the embodiments described above, a plurality of antenna elements will be arranged in such manner that the 3 dB beamwidths of their main beams will be in contact, so that a continuous region can be covered.

As has now been explained, according to this invention, two beams with equiangular spacing can be formed at a single antenna face, and multiple beams can be generated by combining a plurality of such antenna faces. This makes it possible to reduce the size of an antenna device and to decrease the wind load sustained by an antenna, whereby it becomes possible to mount many antennas on a single supporting structure and to achieve substantial weight reduction of a supporting structure.

We claim:

1. A multibeam antenna device comprising:

a plurality of antenna elements arranged along at least two sides of a polygon, two adjoining ones of said plurality of antenna elements being connected at a split angle $\beta$ satisfying the condition $\beta<180°$, each of said plurality of antenna elements comprising:

two radiators, and means for setting relative feed phase angles for said two radiators, said means for setting relative feed phase angles comprising:

a hybrid circuit including first and second antenna-side terminals and first and second base station-side terminals, said hybrid circuit having directional coupling characteristics such that respective signals at said first and second base station-side terminals become 90° out-of-phase signals at said first and second antenna-side terminals;

each of said antenna elements forming two directional beams outwards, wherein:

at each of said plurality of antenna elements, said two directional beams are formed symmetrically with respect to a perpendicular to a face of said respective one of said plurality of antenna elements; and when an angle between said two directional beams is $\alpha$ degrees, said split angle $\beta$ between said two adjoining ones of said plurality of antenna elements is set, in degrees, substantially to:

$$\beta=180-2\alpha.$$

2. A multibeam antenna device according to claim 1, further comprising:

a phase shifter between said hybrid circuit and at least one of said two radiators.

3. A multibeam antenna device according to claim 1, wherein:

each of said plurality of antenna elements comprises an array antenna formed by two groups of radiators.

4. A multibeam antenna device according to claim 1, wherein said plurality of antenna elements comprise:

a first array antenna and a second array antenna each comprising N vertically arrayed radiators (where N is an integer equal to or greater than 2), said first array antenna being adjacent to said second array antenna, each of said first array antenna and said second array antenna being divided into M blocks (where M is an integer such that $2 \leqq M \leqq N$);

a plurality M of hybrid circuits, each of said plurality of hybrid circuits including:

a first and a second antenna-side terminal, and a first and a second base station-side terminal, each of said plurality M of hybrid circuits having directional coupling characteristics such that respective signals at said first and second base station-side terminals of said respective plurality of hybrid circuits become 90° out-of-phase signals at said first and second antenna-side terminals of said respective one of said plurality of hybrid circuits;

a plurality M of first phase shifters;

a plurality M of second phase shifters; and first and second power dividers which respectively have a plurality M of terminals on an antenna side and one terminal on a base station side;

said first and second antenna-side terminals of said plurality of hybrid circuits corresponding to two horizontally adjacent blocks of said first and second array antennas are connected to said radiators of said two horizontally adjacent blocks;

said first base station-side terminals of said M hybrid circuits are connected respectively via respective ones of said plurality M of first phase shifters to said first power divider;

said second base station-side terminals of said M hybrid circuits are connected respectively via respective ones of said plurality M of second phase shifters to said second power divider.

5. A multibeam antenna device according to claim 1, wherein said plurality of antenna elements comprise:

a first array antenna and a second array antenna each comprising N vertically arrayed radiators (where N is an integer equal to or greater than 2), said first array antenna being adjacent to said second array antenna, each of said first array antenna and said second array antenna being divided into M blocks (where M is an integer such that $2 \leqq M \leqq N$);

a plurality of hybrid circuits, each of said plurality of hybrid circuits including:

a first and a second antenna-side terminal, and a first and a second base station-side terminal, each of said plurality of hybrid circuits having directional coupling characteristics such that respective signals at said first and second base station-side terminals of said respective plurality of hybrid circuits become 90° out-of-phase signals at said first and second antenna-side terminals of said respective one of said plurality of hybrid circuits;

a plurality of first phase shifters;

a plurality of second phase shifters; and first and second power dividers which respectively have a plurality of terminals on an antenna side and one terminal on a base station side;

horizontally adjacent radiators of said first and second array antennas are respectively connected to said first and second antenna-side terminals of a corresponding one of said plurality of hybrid circuits;

said first base station-side terminals of one of said plurality of hybrid circuits pertaining to a same block are joined together and then connected via said first phase shifter to said first power divider; and said second base station-side terminals of said one of said plurality of hybrid circuits pertaining to said same block are joined together and then connected via said second phase shifter to said second power divider.

6. A multibeam antenna device according to claim 1, wherein:

said two directional beams are formed asymmetrically with respect to a perpendicular to a face of said respective one of said plurality of antenna elements;

when an angle between said two directional beams is $\alpha$ and a straight line that bisects said angle between said two directional beams is set at an inclination of $\delta$ from said perpendicular to said face of said respective one of said plurality of antenna elements in a direction of a joining part of said two adjoining ones of said plurality of antenna elements, said split angle $\beta$ between said two adjoining ones of said plurality of antenna elements is set, in degrees, substantially to:

$$\beta=180-2(\alpha+\delta).$$

7. A multibeam antenna device according to claim 6, wherein:

said two radiators and two additional radiators are arranged such that perpendiculars to respective faces of said two radiators and said two additional radiators become approximately parallel to a straight line that bisects an angle formed by said two directional beams formed respectively thereby.

8. A multibeam antenna device according to claim 7, wherein:

said plurality of antenna elements are respectively arranged on all sides of a polygon.

9. A multibeam antenna device according to claim 8, wherein:

said polygon is a regular n-sided polygon;

said angle $\alpha$ between said two directional beams at each of said plurality of antenna elements is set, in degrees, to:

$$\alpha=180/n.$$

10. A multibeam antenna device according to claim 9, wherein:

a tilt angle of said two directional beams of each of said plurality of antenna elements are variable.

11. A multibeam antenna device comprising:

a plurality of antenna elements arranged along at least two sides of a polygon, two adjoining ones of said plurality of antenna elements being connected at a split angle $\beta$ satisfying the condition $\beta<180°$, each of said plurality of antenna elements comprising:

two radiators, and means for setting relative feed phase angles for said two radiators, said means for setting relative feed phase angles comprising:

a hybrid circuit including first and second antenna-side terminals and first and second base station-side terminals, said hybrid circuit having directional coupling characteristics such that respective signals at said first and second base station-side terminals become 90° out-of-phase signals at said first and second antenna-side terminals;

each of said antenna elements forming two directional beams outwards, wherein said plurality of antenna elements comprise:

a first array antenna and a second array antenna each comprising N vertically arrayed radiators (where N is an integer equal to or greater than 2), said first array antenna being adjacent to said second array antenna, each of said first array antenna and said second array antenna being divided into M blocks (where M is an integer such that $2 \leqq M \leqq N$);

a plurality of hybrid circuits, each of said plurality of hybrid circuits including:

a first and a second antenna-side terminal, and a first and a second base station-side terminal, each of said plurality of hybrid circuits having directional coupling characteristics such that respective signals at said first and second base station-side terminals become 90° out-of-phase signals at said first and second antenna-side terminals;

a plurality M of first phase shifters;

a plurality M of second phase shifters;

first and second power dividers which respectively have a plurality of terminals on an antenna-side and one terminal on a base station-side; and a plurality M of third power dividers and a plurality M of fourth power dividers which respectively have a plurality of terminals on an antenna-side and one terminal on a base station-side;

said first and second antenna-side terminals of each of said plurality of hybrid circuits are connected respectively to two corresponding horizontally adjacent ones of said radiators of said first array antenna and said second array antenna;

said first base station-side terminals of ones of said plurality of hybrid circuits pertaining to a same block are respectively connected to said antenna-side terminals of one of said plurality M of third power dividers;

said second base station-side terminals of ones of said plurality of hybrid circuits pertaining to said same block are respectively connected to said antenna-side terminals of one of said plurality M of fourth power dividers;

said base station-side terminals of said one of said plurality M of third power dividers and said one of said plurality M of fourth power dividers are respectively connected via respective ones of said plurality M of first phase shifters and said plurality M of second phase shifters to said first and second power dividers.

12. A multibeam antenna device comprising:

at least two first radiators on a first surface of a polygon forming a first antenna element, said first antenna element forming at least two directional beams outwards;

at least two second radiators on a second surface of said polygon forming a second antenna element, said second antenna element forming at least two directional beams outwards, said second antenna element being joined to said first antenna element at a split angle $\beta<180°$;

a first hybrid circuit for setting a first relative feed phase angle for said at least two first radiators of said first antenna element, and a second hybrid circuit for setting a second relative feed phase angle for said at least two second radiators of said second antenna element, said first hybrid circuit and said second hybrid circuit each including first and second antenna-side terminals and first and second base station-side terminals, said first hybrid circuit and said second hybrid circuit having directional coupling characteristics such that respective signals at said first and second base station-side terminals become 90° out-of-phase signals at said first and second antenna-side terminals, wherein:

at each of said first and second antenna elements, said two directional beams are formed symmetrically with respect to a perpendicular to a face of said respective one of said first and second antenna elements; and when an angle between said two directional beams is $\alpha$ degrees, said split angle $\beta$ between said first and second antenna elements is set, in degrees, substantially to:

$$\beta=180-2\alpha.$$

13. A multibeam antenna device comprising:

a plurality of antenna elements arranged along at least two sides of a polygon, two adjoining ones of said plurality of antenna elements being connected at a split angle $\beta$ satisfying the condition $\beta<180°$, each of said plurality of antenna elements comprising:

two radiators, and means for setting relative feed phase angles for said two radiators, said means for setting relative feed phase angles comprising:

a hybrid circuit including first and second antenna-side terminals and first and second base station-side terminals, said hybrid circuit having directional coupling characteristics such that respective signals at said first and second base station-side terminals become 90° out-of-phase signals at said first and second antenna-side terminals;

each of said two antenna elements forming two directional beams outwards, wherein:

said two directional beams are formed asymmetrically with respect to a perpendicular to a face of said respective one of said plurality of antenna elements;

when an angle between said two directional beams is $\alpha$ and a straight line that bisects said angle between said two directional beams is set at an inclination of $\delta$ from said perpendicular to said face of said respective one of said plurality of antenna elements in a direction of a joining part of said two adjoining ones of said plurality of antenna elements, said split angle $\beta$ between said two adjoining ones of said plurality of antenna elements is set, in degrees, substantially to:

$$\beta=180-2(\alpha+\delta).$$

14. A multibeam antenna device according to claim 13, further comprising:

a phase shifter between said hybrid circuit and at least one of said two radiators.

15. A multibeam antenna device according to claim 13, wherein:

each of said plurality of antenna elements comprises an array antenna formed two groups of radiators.

16. A multibeam antenna device according to claim 13, wherein:

said two radiators and two additional radiators are arranged such that perpendiculars to respective faces of said two radiators and said two additional radiators become approximately parallel to a straight line that bisects an angle formed by said two directional beams formed respectively thereby.

17. A multibeam antenna device according to claim 16, wherein:

said plurality of antenna elements are respectively arranged on all sides of a polygon.

18. A multibeam antenna device according to claim 17, wherein:

said polygon is a regular n-sided polygon;

said angle $\alpha$ between said two directional beams at each of said plurality of antenna elements is set, in degrees, to:

$$\alpha=180/n.$$

19. A multibeam antenna device according to claim 18, wherein:

a tilt angle of said two directional beams of each of said plurality of antenna elements are variable.

20. A multibeam antenna device comprising:

at least two first radiators on a first surface of a polygon forming a first antenna element, said first antenna element forming at least two directional beams outwards;

at least two second radiators on a second surface of said polygon forming a second antenna element, said second antenna element forming at least two directional beams outwards, said second antenna element being joined to said first antenna element at a split angle $\beta<180°$;

a first hybrid circuit for setting a first relative feed phase angle for said at least two first radiators of said first antenna element, and a second hybrid circuit for setting a second relative feed phase angle for said at least two second radiators of said second antenna element, said first hybrid circuit and said second hybrid circuit each including first and second antenna-side terminals and first and second base station-side terminals, said first hybrid circuit and said second hybrid circuit having directional coupling characteristics such that respective signals at said first and second base station-side terminals become 90° out-of-phase signals at said first and second antenna-side terminals, wherein said two directional beams are formed asymmetrically with respect to a perpendicular to a face of said respective one of said first and second antenna elements;

when an angle between said two directional beams is $\alpha$ and a straight line that bisects said angle between said two directional beams is set at an inclination of $\delta$ from said perpendicular to said face of said respective one of said first and second antenna elements in a direction of a joining part of said two adjoining ones of said first and second antenna elements, said split angle $\beta$ between said two adjoining ones of said first and second antenna elements is set, in degrees, substantially to:

$$\beta=180-2(\alpha+\delta).$$

* * * * *

UNITED STATES PATENT AND TRADEMARK OFFICE

CERTIFICATE OF CORRECTION

| | | |
|---|---|---|
| PATENT NO. | : | 5,686,926 |
| DATED | : | November 11, 1997 |
| INVENTOR(S) | : | KIJIMA et al. |

It is certified that error appears in the above-identified patent and that said Letters Patent is hereby corrected as shown below:

TITLE PAGE

Please change the Related U.S. Application Data to:

[63] Continuation of Ser. No. 256,926, Oct. 14, 1994, Abandoned, which was the national phase based on international application number PCT/JP93/01740, filed Dec. 1, 1993.

Please change first paragraph of Column 1 to read:

This is a continuation of Application Ser. No. 08/256,926, filed Oct. 14, 1994 Abandoned, which was the national phase based on international application number PCT/JP93/01740, filed Dec. 1, 1993.

Signed and Sealed this

Twenty-eighth Day of September, 1999

*Attest:*

Q. TODD DICKINSON

*Attesting Officer*

*Acting Commissioner of Patents and Trademarks*